US010137694B2

(12) United States Patent
Tsukahara

(10) Patent No.: US 10,137,694 B2
(45) Date of Patent: Nov. 27, 2018

(54) LIQUID SUPPLY UNIT AND LIQUID CONSUMPTION SYSTEM

(71) Applicant: SEIKO EPSON CORPORATION, Tokyo (JP)

(72) Inventor: Katsutomo Tsukahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/318,453

(22) PCT Filed: Jun. 15, 2015

(86) PCT No.: PCT/JP2015/002980
§ 371 (c)(1),
(2) Date: Dec. 13, 2016

(87) PCT Pub. No.: WO2015/194154
PCT Pub. Date: Dec. 23, 2015

(65) Prior Publication Data

US 2017/0144445 A1 May 25, 2017

(30) Foreign Application Priority Data

Jun. 16, 2014 (JP) ..... 2014-123294
Aug. 11, 2014 (JP) ..... 2014-163439

(51) Int. Cl.
*B41J 2/175* (2006.01)

(52) U.S. Cl.
CPC ..... *B41J 2/17523* (2013.01); *B41J 2/1753* (2013.01); *B41J 2/17513* (2013.01);
(Continued)

(58) Field of Classification Search
CPC .. B41J 2/17509; B41J 2/17513; B41J 2/1752; B41J 2/17523; B41J 2/17526; B41J 2/1753; B41J 2/17546; B41J 2/17553; B41J 2002/17516; B65D 31/00; B65D 33/06; Y10T 137/7039
See application file for complete search history.

(56) References Cited

U.S. PATENT DOCUMENTS 5,506,611 A * 4/1996 Ujita ..... B41J 2/17503 347/19
5,788,388 A * 8/1998 Cowger ..... B41J 2/17566 347/19

(Continued)

FOREIGN PATENT DOCUMENTS

JP 07-047685 A 2/1995
JP 2004-066488 A 3/2004

(Continued)

*Primary Examiner* — Anh T. N. Vo

(57) ABSTRACT

There is provided a liquid supply unit provided with a liquid container that is configured to supply a liquid to a liquid consuming apparatus. The liquid supply unit includes a unit housing located below the liquid consuming apparatus and configured to be detachably mounted to the liquid consuming apparatus; the liquid container configured to be placed inside of the unit housing and provided with a liquid supply portion that is arranged to flow out the liquid; and a liquid introduction portion configured to be connected with the liquid supply portion and to flow the liquid from the liquid supply portion to the liquid consuming apparatus, the liquid introduction portion.

24 Claims, 14 Drawing Sheets

(52) U.S. Cl.
CPC ..... *B41J 2/17526* (2013.01); *B41J 2/17546* (2013.01); *B41J 2002/17516* (2013.01)

(56) References Cited

U.S. PATENT DOCUMENTS 5,847,736 A 12/1998 Kanbayashi et al.
6,540,321 B1 * 4/2003 Hirano ..... B41J 2/17546 347/22
7,048,348 B2 * 5/2006 Mochizuki ..... B41J 2/17546 347/85
7,249,831 B2 * 7/2007 Childers ..... B41J 2/1752 347/85
7,452,062 B2 * 11/2008 Kimura ..... B41J 2/16523 347/85
7,845,776 B2 * 12/2010 Kachi ..... B41J 2/1752 347/84
2003/0184628 A1 10/2003 Sasaki
2005/0243148 A1 11/2005 Miyazawa et al.
2007/0229613 A1 10/2007 Kachi
2011/0316946 A1 * 12/2011 King ..... A63F 13/00 347/86
2013/0141499 A1 6/2013 Tomoguchi et al.
2014/0026416 A1 * 1/2014 Shirono ..... B41J 2/17523 29/890.1
2014/0253645 A1 9/2014 Tsukahara et al.
2014/0360596 A1 12/2014 Tsukahara et al.
2014/0362148 A1 12/2014 Ishizawa et al.
2014/0376948 A1 12/2014 Tomoguchi et al.
2016/0121617 A1 5/2016 Tsukahara et al.
2016/0176195 A1 6/2016 Kawate et al.

FOREIGN PATENT DOCUMENTS

JP 2007-268972 A 10/2007
JP 2013-139142 A 7/2013
JP 2014-172263 A 9/2014
JP 2014-237223 A 12/2014
WO 95/31335 A1 11/1995
WO 97/42035 A1 11/1997
WO 2004/037541 A1 5/2004
WO 2014/196205 A1 12/2014

* cited by examiner

VIEW FROM ARROW F5

LIQUID SUPPLY UNIT AND LIQUID CONSUMPTION SYSTEM

TECHNICAL FIELD

The present disclosure relates to a technique of supplying a liquid to a liquid consuming apparatus.

BACKGROUND ART

A conventionally known technique supplies ink from an ink containing bag to a printer in the state that the ink containing bag is placed in a cartridge case configured to allow the ink containing bag to be pulled out of the cartridge case (for example, Patent Literature 1).

CITATION LIST

Patent Literature

PTL 1: WO 2004/037541 A1

SUMMARY

Technical Problem

According to the technique of Patent Literature 1, a mounting structure of the cartridge case is provided next to a paper exit portion in the printer. This may lead to such a problem that the size of the printer is expanded in a horizontal direction. There may be a change in design, for example, increasing the amount of ink that is to be supplied to the printer or increasing the number of different inks (for example, the number of different ink colors) that are to be supplied to the printer. When the installation space of the printer is limited and there is a difficulty in size expansion of the printer in the horizontal direction, it may be difficult to provide an additional ink containing bag and an additional cartridge case next to the paper exit portion.

These problems are not characteristic of the ink containing bag or the case configured to receive the ink containing bag placed therein, but are commonly found in the technology with regard to a liquid supply unit including a liquid container configured to supply a liquid to a liquid consuming apparatus such as printer and a housing configured to receive the liquid container placed inside thereof.

In order to solve at least part of the problems described above, an object of the disclosure is to provide a technique that suppresses size expansion of a liquid consuming apparatus in a horizontal direction and readily responds to a change in design, for example, increasing the number of liquid containers to be placed therein. Other needs include, for example, cost reduction, resource saving, easy manufacture, improvement of usability and simplification of the configuration over the prior art.

Solution to Problem

In order to solve at least one of the problems described above, the disclosure may be implemented by aspects described below.

(1) According to one aspect of the disclosure, there is provided a liquid supply unit provided with a liquid container that is configured to supply a liquid to a liquid consuming apparatus. The liquid supply unit comprises a unit housing located below the liquid consuming apparatus and configured to be detachably mounted to the liquid consuming apparatus; the liquid container configured to be placed inside of the unit housing and provided with a liquid supply portion that is arranged to flow out the liquid; and a liquid introduction portion configured to be connected with the liquid supply portion and to flow the liquid from the liquid supply portion to the liquid consuming apparatus, the liquid introduction portion.

In the liquid supply unit of this aspect, the unit housing is mounted below the liquid consuming apparatus. This configuration suppresses size expansion of the liquid consumption system including the liquid consuming apparatus and the liquid supply unit in the horizontal direction and readily responds to a change in design, for example, increasing the number of the liquid containers to be placed therein. This accordingly allows for an increase in the amount of the liquid or an increase in the number of different liquids supplied to the liquid consuming apparatus without increasing the installation area. The liquid container of the heavier weight is placed below the liquid consuming apparatus. This configuration causes the center of gravity of the liquid consumption system to be located at the lower position compared with the center of gravity in the configuration that the liquid container is placed above the liquid consuming apparatus. This accordingly stabilizes the attitude of the liquid consumption system.

(2) In the liquid supply unit of the above aspect, the liquid introduction portion may be configured such as to be visible from outside of the unit housing in a state that the unit housing is mounted to the liquid consuming apparatus.

In the liquid supply unit of this aspect, the liquid introduction portion is configured to be visible. This configuration enables the liquid supply portion to be connected with the liquid introduction portion, while allowing the position of the liquid introduction portion to be checked.

(3) The liquid supply unit of the above aspect may further comprise a first electrical connection structure placed inside of the unit housing. The liquid container may have a contact configured to be brought into contact with the first electrical connection structure and thereby to be electrically connected with the first electrical connection structure.

The liquid supply unit of this aspect enables the first electrical connection structure to be electrically connected with the contact.

(4) In the liquid supply unit of the above aspect, in a state that the unit housing is mounted to the liquid consuming apparatus, the first electrical connection structure may be configured such as to be visible from outside of the unit housing.

In the liquid supply unit of this aspect, the first electrical connection structure is configured to be visible. This configuration enables the contact to be brought into contact with the first electrical connection structure, while allowing the position of the first electrical connection structure to be checked.

(5) The liquid supply unit of the above aspect may further comprise housing-side electrical wiring configured to be electrically connected with the first electrical connection structure and placed inside of the unit housing; and a second electrical connection structure configured to be connected with one end portion of the housing-side electrical wiring and arranged to electrically connect the housing-side electrical wiring with an apparatus-side electricity junction structure of the liquid consuming apparatus that is electrically connected with a controller of the liquid consuming apparatus. The second electrical connection structure may be placed at a position fixed relative to the unit housing.

In the liquid supply unit of this aspect, the housing-side electrical wiring is placed inside of the unit housing. This configuration reduces the possibility that the housing-side electrical wiring is damaged. This configuration also enables the housing-side electrical wiring to be readily connected electrically with the apparatus-side electricity junction structure by means of the second electrical connection structure.

(6) The liquid supply unit of the above aspect may further comprise a liquid introducing flow path portion configured to be connected with the liquid introduction portion and placed inside of the unit housing; and a liquid connection structure configured to be connected with one end portion of the liquid introducing flow path portion and arranged to make the liquid introducing flow path portion communicate with an apparatus-side liquid junction structure of the liquid consuming apparatus that is configured to communicate with a liquid ejection head of the liquid consuming apparatus. The liquid connection structure may be placed at a position fixed relative to the unit housing.

In the liquid supply unit of this aspect, the liquid introducing flow path portion is placed inside of the unit housing. This configuration reduces the possibility that the liquid introducing flow path portion is damaged. This configuration also readily makes the liquid introducing flow path portion communicate with the apparatus-side liquid junction structure by means of the liquid connection structure.

(7) In the liquid supply unit of the above aspect, the unit housing may include a mounting structure configured to be fit in a housing of the liquid consuming apparatus, such as to mount the unit housing to the liquid consuming apparatus.

The liquid supply unit of this aspect enables the unit housing to be readily mounted to the liquid consuming apparatus by fitting the unit housing into the housing of the liquid consuming apparatus.

(8) The liquid supply unit of the above aspect may further comprise a positioning structure configured to determine position of the unit housing relative to the housing.

The liquid supply unit of this aspect enables the position of the unit housing to be readily determined relative to the housing.

(9) In the liquid supply unit of the above aspect, the mounting structure may include an opening configured in conjunction with the housing to define and form a space that causes a hand to be inserted from outside of the unit housing to inside of the unit housing, in a state that the unit housing is mounted to the housing.

The liquid supply unit of this aspect reduces the likelihood that the user's hand is caught between the liquid consuming apparatus and the unit housing in the process of mounting and demounting the unit housing.

(10) In the liquid supply unit of the above aspect, the liquid introduction portion may have a base end portion and a leading end portion, and a direction in which the liquid introduction portion is extended from the base end portion toward the leading end portion may be one direction among a vertically upward direction, a vertically downward direction and a horizontal direction.

The liquid supply unit of this aspect enables the liquid supply portion to be readily connected with the liquid introduction portion, compared with a configuration that the liquid introduction portion is inclined relative to the vertical direction or relative to the horizontal direction.

(11) In the liquid supply unit of the above aspect, the unit housing may include a container case configured to be movable in a horizontal direction, such as to be protruded from the liquid consuming apparatus in the horizontal direction, and the liquid container may be placed in the container case.

In the liquid supply unit of this aspect, the liquid container can be readily placed in the container case by protruding the container case in the horizontal direction.

(12) In the liquid supply unit of the above aspect, the liquid container may include a liquid container body provided to have elasticity and configured to contain the liquid therein. The liquid container body may have a first main surface that forms a primary surface and a second main surface that forms another primary surface and is opposed to the first main surface. The liquid container may be placed in the container case such that a direction in which the first main surface and the second main surface are opposed to each other is a vertical direction.

The liquid supply unit of this aspect can stabilize the attitude of the liquid container in the container case.

(13) In the liquid supply unit of the above aspect, the liquid introduction portion may be configured to be rotated about a fulcrum, so as to be connected with the liquid supply portion.

In the liquid supply unit of this aspect, the liquid introduction portion can be connected with the liquid supply portion by rotating the liquid introduction portion.

(14) In the liquid supply unit of the above aspect, the liquid introduction portion may be placed inside of the container case, and a direction in which the liquid introduction portion is extended may intersect with a moving direction of the container case.

In the liquid supply unit of this aspect, the direction in which the liquid introduction portion is extended intersects with the moving direction of the container case. This configuration causes the liquid container to be moved along a direction intersecting with the moving direction (i.e., along the direction in which the liquid introduction portion is extended), so as to connect the liquid supply portion with the liquid introduction portion.

(15) In the liquid supply unit of the above aspect, a moving direction of the container case may intersect with a moving direction of the liquid container in order to connect the liquid supply portion with the liquid introduction portion.

The liquid supply unit of this aspect causes the liquid container to be moved along a direction intersecting with the moving direction, so as to connect the liquid supply portion with the liquid introduction portion.

(16) The liquid supply unit of the above aspect may further comprise a pump configured to transfer the liquid contained in the liquid container to the liquid consuming apparatus.

The liquid supply unit of this aspect enables the liquid to be stably supplied from the liquid container located below the liquid consuming apparatus toward the liquid consuming apparatus.

All the plurality of components included in each of the aspects of the disclosure described above are not essential, but some components among the plurality of components may be appropriately changed, omitted or replaced with other additional components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the disclosure described above may be combined with part or all of the technical features included in another aspect of the disclosure described above to provide one independent aspect of the disclosure.

For example, one aspect of the disclosure may be implemented as an apparatus comprising one or more elements out of a plurality of elements, i.e., a unit housing, a liquid container and a liquid introduction portion. Accordingly this apparatus may include a unit housing or may not include the unit housing. This apparatus may also include a liquid container or may not include the liquid container. This apparatus may also include a liquid introduction portion or may not include the liquid introduction portion. Any of these various aspects solves at least one of various problems, such as downsizing of the apparatus, cost reduction, resource saving, easy manufacture and improvement of usability. Part or all of the technical features in each of the aspects of the liquid supply unit described above may be applied to this apparatus.

The disclosure may be implemented by any of various aspects other than the liquid supply unit, for example, a method of manufacturing the liquid supply unit and a liquid consumption system including a liquid consuming apparatus and the liquid supply unit.

DESCRIPTION OF EMBODIMENTS

A. First Embodiment

A-1. General Configuration of Liquid Consumption System 1000

Figure 1:
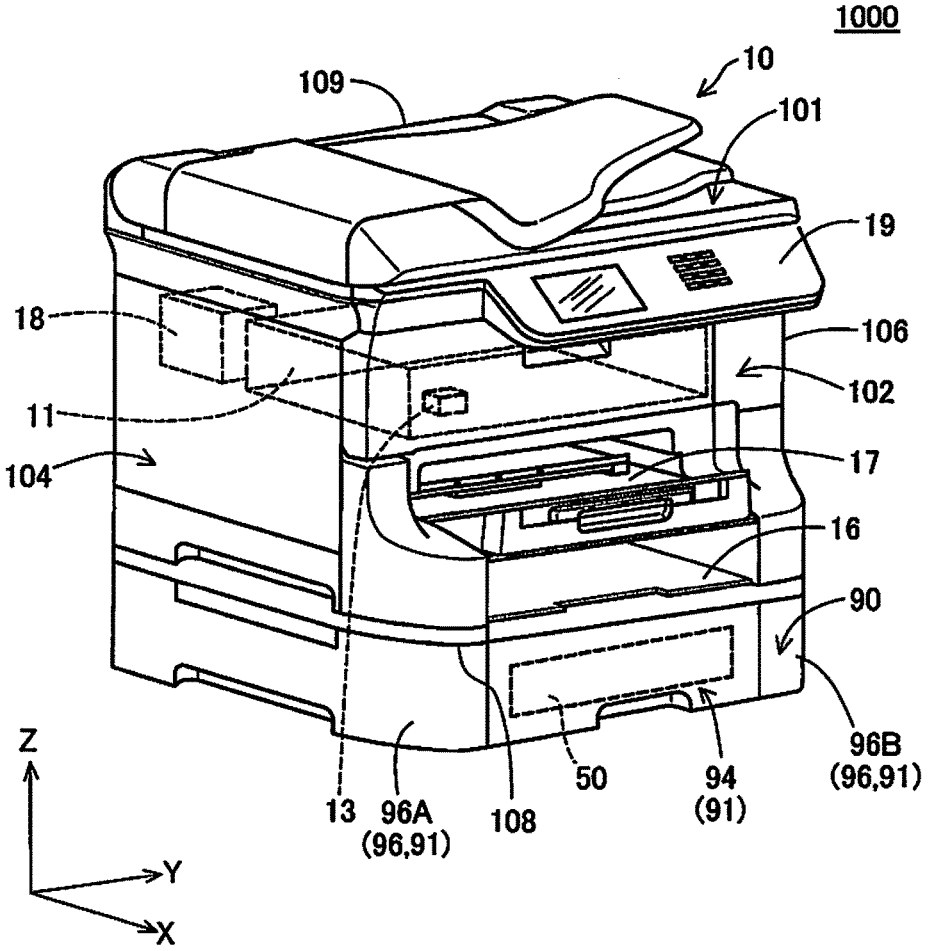
FIG. 1 is a perspective view illustrating a liquid consumption system according to a first embodiment of the disclosure.

FIG. 1 is a perspective view illustrating a liquid consumption system 1000 according to a first embodiment of the disclosure. XYZ axes that are orthogonal to one another are illustrated in FIG. 1. The XYZ axes are also shown in other drawings as needed.

The liquid consumption system 1000 includes a printer 10 as a liquid consuming apparatus and a liquid supply unit 90. In the use state of the liquid consumption system 1000, the liquid consumption system 1000 is placed on a horizontal plane defined by an X-axis direction and a Y-axis direction. A Z-axis direction is defined as vertical direction (top-bottom direction); −Z-axis direction is defined as vertically downward direction and +Z-axis direction is defined as vertically upward direction.

The printer 10 includes a housing (apparatus-side housing) 19, a recording mechanism 11 and a controller 18 placed inside of the housing 19, a paper feed slot 16 and a paper eject tray 17. The housing 19 is in an approximately rectangular parallelepiped shape. The housing 19 includes a front face (first surface, first wall) 102, a left side face (first side face, first side wall) 104, a right side face (second side face, second side wall) 106, a rear face (second surface, second wall) 109, a top face (third surface, third wall) 101 and a bottom face (fourth surface, fourth wall) 108. The respective surfaces 102, 104, 106, 109, 101 and 108 form the outer shell of the printer 10.

The front face 102 and the rear face 109 are opposed to each other. The left side face 104 and the right side face 106 are opposed to each other. The front face 102, the rear face 109, the left side face 104 and the right side face 106 are surfaces that are approximately perpendicular to the installation plane of the printer 10. The top face 101 and the bottom face 108 are opposed to each other. The top face 101 and the bottom face 108 are surfaces that are approximately horizontal to the installation plane of the printer 10. The terms "approximately perpendicular" and "approximately horizontal" herein include the meanings of almost "perpendicular" and almost "horizontal", in addition to the meanings of completely "perpendicular" and completely "horizontal". In other words, the respective surfaces 102, 104, 106, 109, 101 and 108 are not completely flat surfaces but are surfaces including concaves, convexes and the like, so that each of the surfaces 102, 104, 106, 109, 101 and 108 may be almost "perpendicular" or almost "horizontal" in appearance.

A direction in which the front face 102 and the rear face 109 are opposed to each other is the X-axis direction. A direction in which the left side face 104 and the right side face 106 are opposed to each other is the Y-axis direction. A direction in which the top face 101 and the bottom face 108 are opposed to each other is the Z-axis direction. The X-axis direction denotes the "depth direction" of the printer 10. The Y-axis direction denotes the "width direction" of the printer 10. The Z-axis direction denotes the "height direction" of the printer 10.

The controller 18 controls various operations of the liquid consumption system 1000 (for example, the operation of the recording mechanism 11). The controller 18 is electrically connected with a circuit board of a liquid container 50 described later in the liquid supply unit 90, such that information with regard to the liquid container 50 (for example, the remaining amount of the liquid and the color information of the contained liquid) is transmitted between the controller 18 and the circuit board.

The recording mechanism 11 has a liquid ejection head 13 configured to eject ink as the liquid onto a recording medium (for example, printing paper). The ink is supplied from the liquid supply unit 90 (more specifically, from the liquid container 50 described later) to the liquid ejection head 13.

More specifically, the ink contained in the liquid container 50 is sucked by a supply mechanism (not shown) that is provided in the printer 10 and is equipped with a pump function, so as to be supplied to the liquid ejection head 13. The recording mechanism 11 ejects ink from the liquid ejection head 13 onto printing paper in response to a control signal from the controller 18, so as to print (record) images and the like. More specifically, while paper is fed along the +X-axis direction (sub-scanning direction) by the recording mechanism 11, the liquid ejection head 13 is moved in the Y-axis direction (main scanning direction) to eject ink onto the paper, so as to make a print on the paper. A stepping motor (not shown) is driven to move the liquid ejection head 13 via a timing belt (not shown). The printer 10 of this embodiment is a serial head-type printer that causes the liquid ejection head 13 to be moved in the main scanning direction. According to another embodiment, the printer 10 may be a line head-type printer that causes the liquid ejection head 13 that is in an elongated shape extended in the Y-axis direction to be not moved but fixed.

The paper feed slot 16 is configured to allow a plurality of recording media (for example, multiple sheets of printing paper) as the printing subject to be placed therein. The paper feed slot 16 is open on its front face 102-side and allows the recording media to be placed inward from this opening. The paper eject tray 17 is provided on the front face 102. The paper eject tray 17 is configured to eject the recording media after recording by the recording mechanism 11.

The liquid supply unit 90 includes a liquid container 50 configured to contain ink that is to be supplied to the printer 10. The liquid supply unit 90 is located below the liquid consuming apparatus 10. When the liquid consumption system 1000 is projected onto a horizontal plane (XY plane), the liquid consuming apparatus 10 and the liquid supply unit 90 have approximately the same outer shapes. According to another embodiment, in the case of projection onto the horizontal plane, the outer shape of the liquid supply unit 90 may be smaller than the outer shape of the liquid consuming apparatus 10. The liquid supply unit 90 includes a unit housing 91 that is detachably mounted to the housing 19 of the printer 10. The unit housing 91 includes a stationary housing 96 placed at a position fixed relative to the printer 10, and a container case 94 surrounded by the stationary housing 96 and configured to be movable in the horizontal direction (X-axis direction in this embodiment). A portion of the stationary housing 96 located on the −Y-axis direction side of the container case 94 is called first stationary housing 96A, and a portion of the stationary housing 96 located on the +Y-axis direction side of the container case 94 is called second stationary housing 96B. The unit housing 91 forms the outer shell of the liquid supply unit 90.

The first stationary housing 96A is located on the −Y-axis direction side of the container case 94. The second stationary housing 96B is located on the +Y-axis direction side of the container case 94. The container case 94 is configured to be drawn out in the +X-axis direction (toward the front face 102-side of the printer 10) and thereby protruded in the horizontal direction relative to the printer 10.

A-2. Configuration of Liquid Container 50

Figure 2:
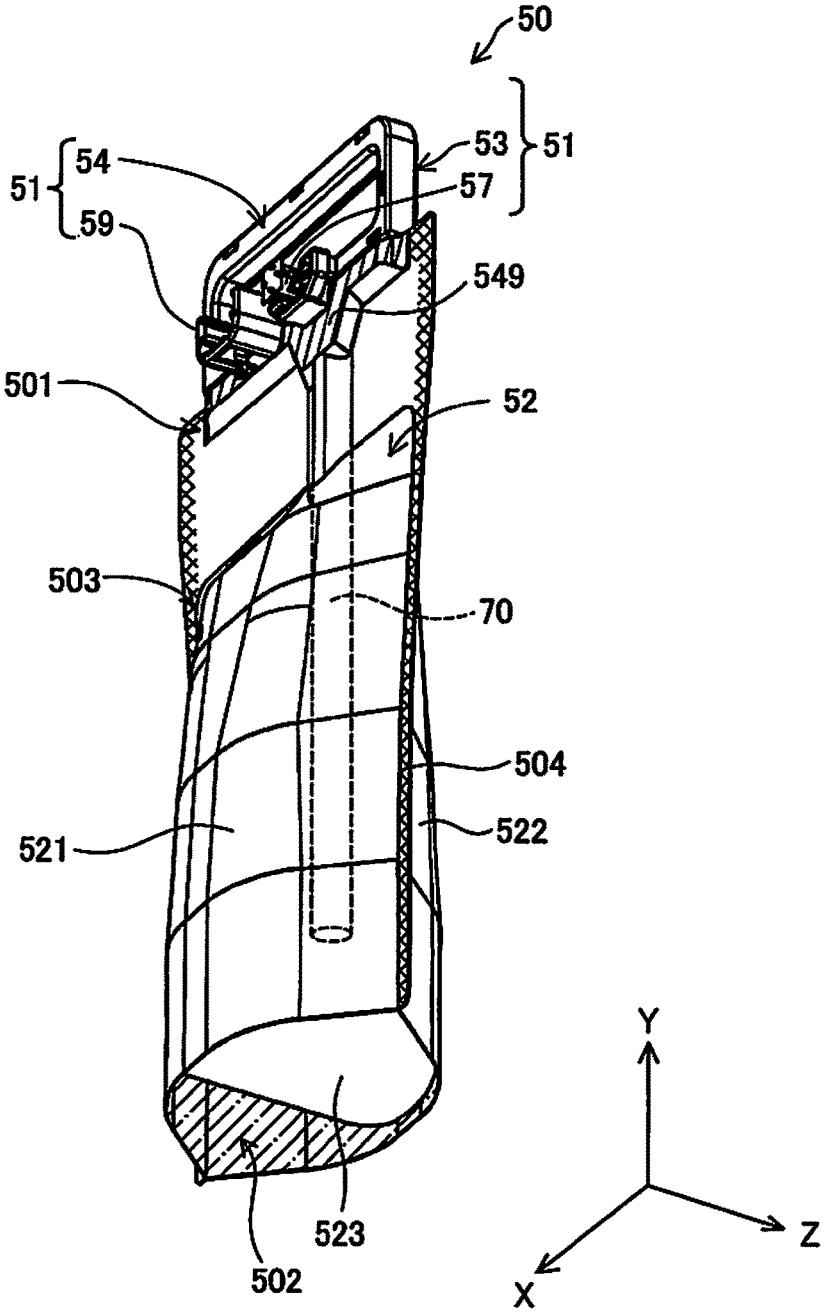
FIG. 2 is a perspective view illustrating a liquid container.
Figure 3:
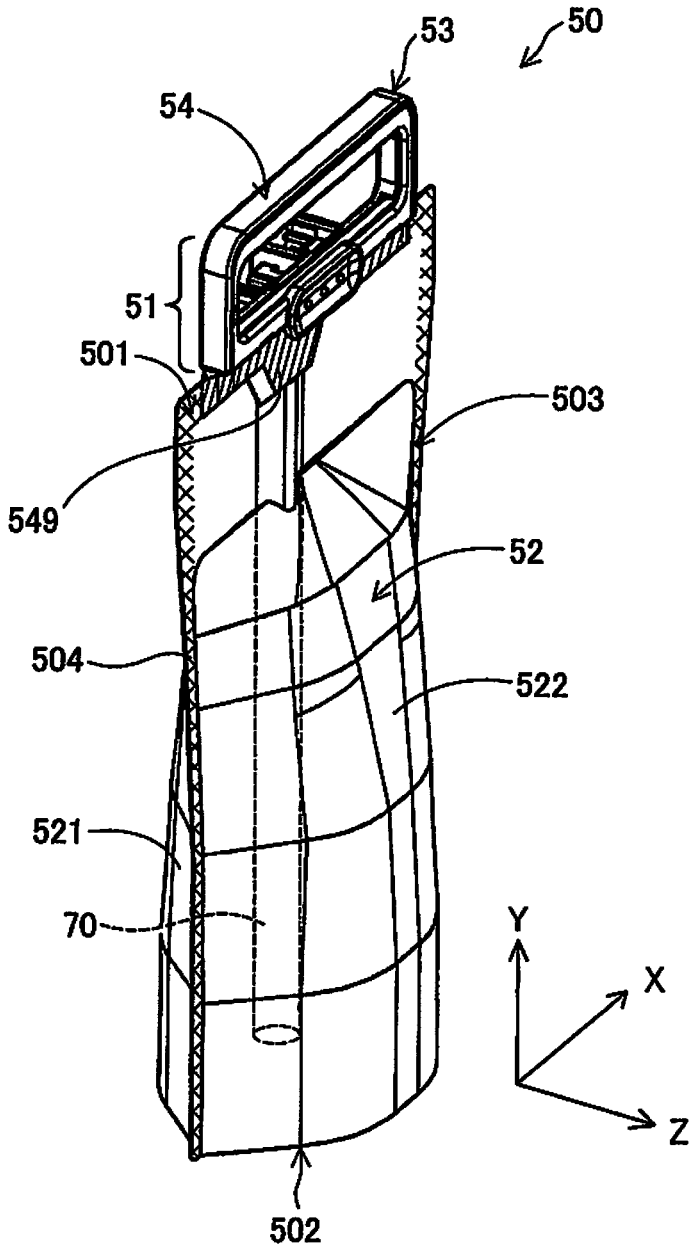
FIG. 3 is a perspective view illustrating the liquid container.
Figure 4:
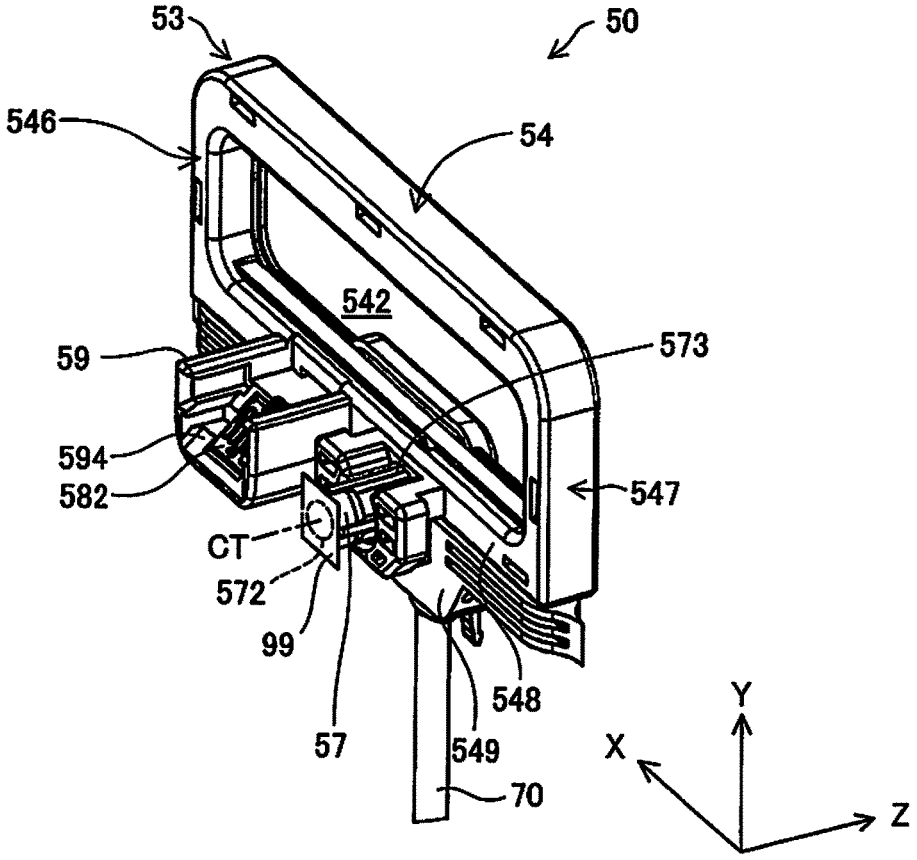
FIG. 4 is a diagram illustrating the liquid container.
Figure 5:
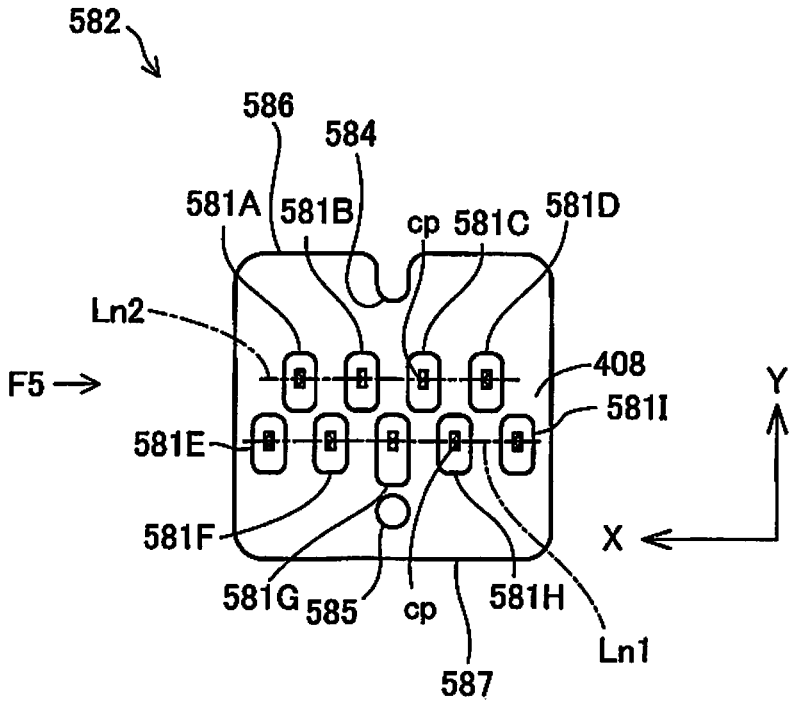
FIG. 5 is a diagram illustrating a circuit board.
Figure 6:
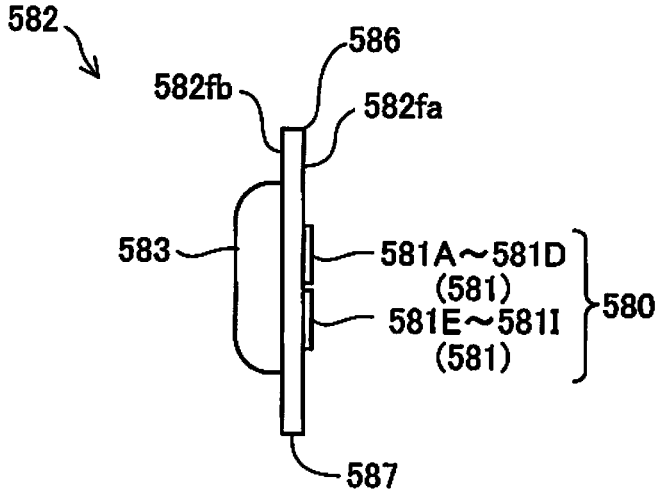
FIG. 6 is a view from an arrow F5 in FIG. 5.

FIG. 2 is a perspective view illustrating the liquid container 50. FIG. 3 is a perspective view illustrating the liquid container 50. FIG. 4 is a diagram illustrating the liquid container 50. FIG. 5 is a diagram illustrating a circuit board 582. FIG. 6 is a view from an arrow F5 in FIG. 5. FIG. 4 is a view illustrating the liquid container 50 with omission of a liquid container body 52. FIGS. 2 to 4 illustrate XYZ axes in the placed state (mounted state) that the liquid container 50 is placed in the container case 94. The Y-axis direction denotes the "height direction" of the liquid container 50. The Z-axis direction denotes the "thickness direction" of the liquid container 50. The X-axis direction denotes the "width direction" of the liquid container 50. The dimensions of the liquid container body 52 of the liquid container 50 decrease in the sequence of the height direction, the width direction and the thickness direction. In other words, in the initial state that the liquid container body 52 is filled with ink, the dimension in the height direction is the largest dimension, and the dimension in the thickness direction is the smallest dimension.

The liquid container 50 (shown in FIG. 4) includes a container body support assembly 51, a liquid container body 52 and a flow path-forming member 70. The container body support assembly 51 includes a handle portion 53, a liquid supply portion 57, a circuit board 582 and a contact placement structure 59. The handle portion 53 is a frame-like member that is open in the Z-axis direction.

The liquid container body 52 (shown in FIG. 2) is configured to contain ink therein. The liquid container body 52 is mounted to the container body support assembly 51 in such a state that its outer surface is exposed. The liquid container body 52 has flexibility and reduces its volume with a decrease of the ink contained therein.

The liquid container body 52 includes a first sheet 521, a second sheet 522 (shown in FIG. 3) and a third sheet 523. The first to the third sheets 521 to 523 are configured to define a space for containing ink inside thereof. In the mounted state of the liquid container 50, the first sheet 521 forms a bottom of the liquid container body 52.

As shown in FIG. 2, a portion of the liquid container body 52 to which the container body support assembly 51 is attached is defined as one end portion 501, and a portion of the liquid container body 52 opposed to the one end portion 501 is defined as other end portion 502. One edge side (+X-axis direction side) portion of the liquid container body 52 is defined as first side edge portion 503, and other edge side (−X-axis direction side) portion of the liquid container body 52 is defined as second side edge portion 504.

Respective peripheral areas of the first sheet 521 and the second sheet 522 are partly welded to each other. More specifically, one end portions 501, first side edge portions 503 and second side edge portions 504 of the respective peripheral areas are welded. For the purpose of better understanding, the welded portions of the first and second sheets 521 and 522 are shown by cross-hatching in FIGS. 2 and 3. The container body support assembly 51 (more specifically, its mounting portion 549) is welded to the one end portion 501 of the liquid container body 52. For the purpose of better understanding, the welded portions of the container body support assembly 51 to the first and second sheets 521 and 522 are shown by solid-line single hatching in FIGS. 2 and 3.

As shown in FIG. 2, a portion of the third sheet 523 is welded to portions of the peripheral areas of the first sheet 521 and the second sheet 522. These welded portions are shown by one-dot chain line single hatching. As described above, the liquid container body 52 of the embodiment is in such a form that the three sheets 521, 522 and 523 are bonded to one another by welding or the like (pouch-like form having a bottom face).

The first to the third sheets 521 to 523 are respectively members having flexibility. The material (substance) employed for the first to the third sheets 521 to 523 may be, for example, polyethylene terephthalate (PET), nylon or polyethylene.

According to this embodiment, the liquid container body 52 is in the form that the first to the third sheets 521 to 523 are bonded to one another by welding or the like. The liquid container body 52 may, however, be any member configured to contain a liquid therein. For example, the liquid container body 52 may be in such a form that the third sheet 523 is omitted and the first sheet 521 and the second sheet 522 are bonded to each other by welding or the like (pillow-type form). The liquid container body 52 may have no flexibility.

Among the sheets forming the outer surface of the liquid container body 52, the first sheet 521 and the second sheet 522 have larger areas than the other sheet (third sheet 523). Accordingly, the first sheet 521 is also called first main surface 521 of the liquid container 50, and the second sheet 522 is also called second main surface 522 of the liquid container 50.

As shown in FIG. 2, the flow path-forming member 70 is placed inside of the liquid container body 52. The flow path-forming member 70 is a tube. In other words, the flow path-forming member 70 is a tubular member. The flow path-forming member 70 has elasticity. The flow path-forming member 70 is formed from, for example, an elastomer or rubber, so as to have elasticity. The flow path-forming member 70 is configured to form inside thereof a flow path that makes inside of the liquid container body 52 communicate with the liquid supply portion 57. The ink contained in the liquid container body 52 is flowed through the flow path in the flow path-forming member 70 to the liquid supply portion 57.

As shown in FIG. 4, the handle portion 53 includes a grip portion 54 located on a +Y-axis direction side end, a mounting portion 549 located on a −Y-axis direction side end and a base portion 548 located between the grip portion 54 and the mounting portion 549 with regard to the Y-axis direction. The handle portion 53 further includes a first connecting portion 546 located on a +X-axis direction side edge and a second connecting portion 547 located on a −X-axis direction side edge.

The grip portion 54, the first connecting portion 546, the second connecting portion 547 and the base portion 548 are respectively in rod-like shapes. The grip portion 54, the first connecting portion 546, the second connecting portion 547 and the base portion 548 form a frame-like member. Accordingly a receiving space 542 in an approximately rectangular shape is defined and formed in the handle portion 53 to receive the user's hand.

The grip portion 54 denotes a portion gripped by the user to hold the liquid container 50. The grip portion 54 is extended along the X-axis direction.

The first connecting portion 546 is a member extended from one edge in the X-axis direction of the grip portion 54 toward the base portion 548 (i.e., in the −Z-axis direction or toward the liquid container body 52 shown in FIG. 2). The second connecting portion 547 is a member extended from the other edge in the X-axis direction of the grip portion 54 toward the base portion 548 (i.e., in the −Z-axis direction or toward the liquid container body 52 shown in FIG. 2). The base portion 548 is a portion opposed to the grip portion 54 across the receiving space 542. The base portion 548 is extended along the X-axis direction. The liquid supply portion 57 and the circuit board holding structure (contact placement structure) 59 are attached to the base portion 548.

The mounting portion 549 is extended along the X-axis direction. The mounting portion 549 is a portion to which the one end portion 501 of the liquid container body 52 (shown in FIG. 2) is mounted by welding or the like.

The liquid supply portion 57 (shown in FIG. 4) is configured to communicate with inside of the liquid container body 52 and supply the ink contained in the liquid container body 52 to the printer 10. More specifically, the ink contained in the liquid container body 52 is flowed through the flow path-forming member 70 and an internal flow path (not shown) of the mounting portion 549 and the base portion 548 and reaches the liquid supply portion 57.

The liquid supply portion 57 includes a liquid supply port 572 on one end and a supply connecting portion 573 on the other end. The liquid supply port 572 is arranged to communicate with inside of the liquid container body 52 and causes the ink contained in the liquid container body 52 to be flowed out to the outside (printer 10). The liquid supply portion 57 is a tubular member (ring-shaped member) extended along the Z-axis direction. The liquid supply portion 57 is provided to be protruded outward (in the −Z-axis direction) from the handle portion 53.

The liquid supply portion 57 has a center axis CT. The center axis CT is parallel to the Z-axis direction. With regard to the Z-axis direction, a direction from the liquid supply port 572 toward the supply connecting portion 573 is +Z-axis direction, and a direction from the supply connecting portion 573 toward the liquid supply port 572 is −Z-axis direction. A valve mechanism is provided inside of the liquid supply portion 57 to open and close an internal flow path of the liquid supply portion 57. Insertion of a liquid introduction portion described later into the liquid supply portion 57 opens the valve mechanism and thereby allows the ink to be flowed from the liquid supply portion 57 toward the liquid introduction portion.

As shown in FIG. 4, in the unused state (initial state) of the liquid container 50, the liquid supply port 572 is closed by a film 99. This configuration suppresses leakage of ink from the liquid supply port 572 to outside before the liquid container 50 is placed in the container case 94. The film 99 is broken by the liquid introduction portion in the process of mounting the liquid container 50.

The contact placement structure 59 has the circuit board 582 placed thereon. The contact placement structure 59 is provided integrally with the handle portion 53. According to this embodiment, the contact placement structure 59 is integrally molded with the handle portion 53, so as to be provided integrally with the handle portion 53. The term "provided integrally" herein means that the contact placement structure 59 is provided in the handle portion 53 to move in conjunction with the motion of the handle portion 53. According to another embodiment, the contact placement structure 59 may be attached to the handle portion 53 by welding or the like, so as to be provided integrally with the handle portion 53.

The contact placement structure 59 is in a recessed shape that is open on the Y-axis direction side (i.e., the side where the grip portion 54 is located). A bottom 594 of the recessed shape is inclined to the Y-axis direction. The circuit board 582 is mounted on the bottom 594, so as to be held on the contact placement structure 59 in such a state that the circuit board 582 is inclined to the direction of the center axis CT.

As shown in FIG. 5, a boss groove 584 is formed on a +Y-axis direction side upper end 586 of the circuit board 582, and a boss hole 585 is formed on a −Y axis direction side lower end 587 of the circuit board 582. The circuit board 582 is fixed to the bottom 594 (shown in FIG. 4) using the boss groove 584 and the boss hole 585.

The circuit board 582 (shown in FIGS. 5 and 6) includes a liquid container-side terminal group 580 provided on a surface 582*fa* and a storage device 583 provided on a rear face 582*fb*. The surface 582*fa* and the rear face 582*fb* are planes.

The liquid container-side terminal group 580 consists of nine terminals 581A to 581I. The storage device 583 stores, for example, information regarding the liquid container 50 (for example, the remaining amount of ink and the color of ink). The storage device 583 is electrically connected with the nine terminals 581A to 581I.

As shown in FIG. 5, the nine liquid container-side terminals 581A to 581I are respectively formed in an approximately rectangular shape. The nine liquid container-side terminals 581A to 581I are arranged to form two lines Ln1 and Ln2 at different positions in the Y-axis direction. The lines Ln1 and Ln2 are parallel to the X-axis direction.

The liquid container-side terminals 581A to 581I respectively have contacts cp formed in their centers to be brought into contact with a first electrical connection structure that is placed inside of the unit housing 91 as described later. The above lines Ln1 and Ln2 may be regarded as lines formed by a plurality of the contacts cp. When there is no need to distinguish among the nine liquid container-side terminals 581A to 581I, these are expressed by a reference sign "581".

A-3. Detailed Configuration of Liquid Consumption System 1000

Figure 7:
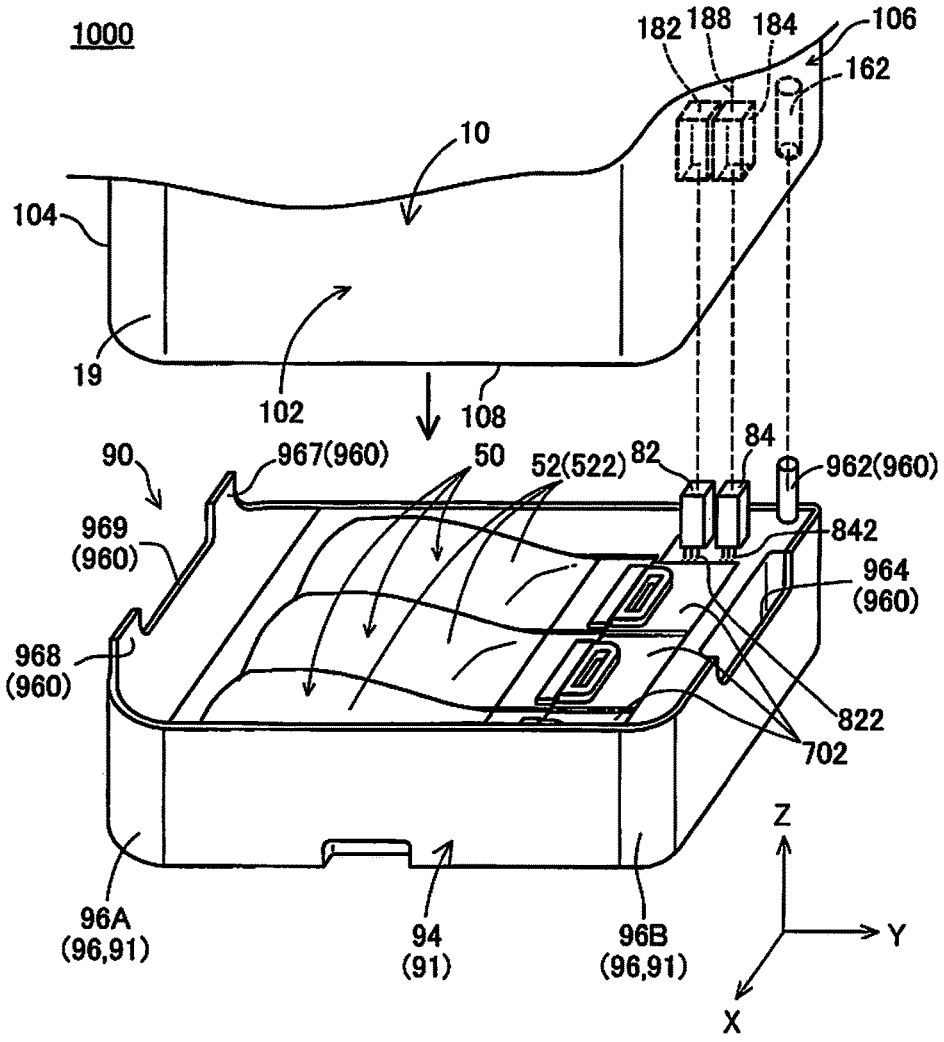
FIG. 7 is a diagram further illustrating the liquid consumption system.
Figure 8:
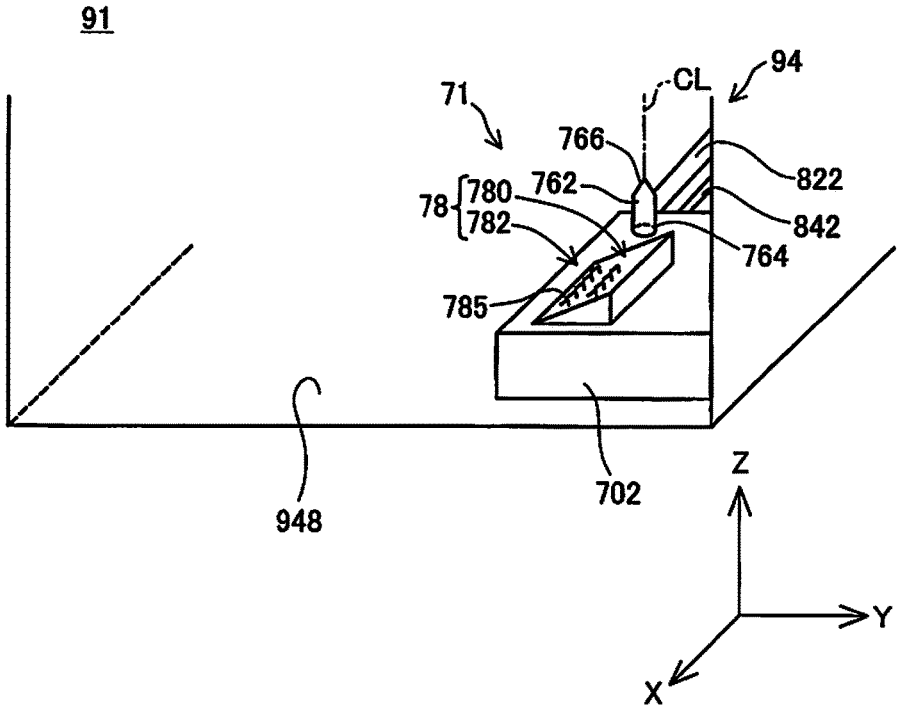
FIG. 8 is a diagram illustrating a connection unit.

FIG. 7 is a diagram further illustrating the liquid consumption system 1000. FIG. 8 is a diagram illustrating a connection unit 71. FIG. 8 illustrates one connection unit 71 located on the most +X-axis direction side among three connection units 71 arranged along the X-axis direction. For the purpose of better understanding, the connection unit 71 placed inside of the container case 94 is shown by solid line.

The housing 19 of the printer 10 (shown in FIG. 7) includes an apparatus-side liquid junction structure 182, an apparatus-side electricity junction structure 184 and an apparatus-side positioning structure 162. The respective structures 182, 184 and 162 are located on the bottom face 108-side in the housing 19. The apparatus-side liquid junction structure 182 is located on an upstream side end of the printer 10 with regard to the flow direction of ink from the liquid container 50 toward the liquid ejection head 13 (shown in FIG. 1) (with regard to the liquid supply direction). The apparatus-side liquid junction structure 182 is a portion that is to be connected with a liquid connection structure 82. The apparatus-side liquid junction structure 182 and the liquid ejection head 13 are arranged to communicate with each other by means of a liquid flow tube such as hose. Connecting the liquid connection structure 82 with the apparatus-side liquid junction structure 182 enables the ink contained in the liquid container 50 to be flowed to the liquid ejection head 13. A valve mechanism is provided inside of the apparatus-side liquid junction structure 182 and is opened when the liquid connection structure 82 is connected with the apparatus-side liquid junction structure 182. The apparatus-side electricity junction structure 184 is electrically connected with the controller 18 by means of electrical wiring (apparatus-side electrical wiring) 188. Electrically connecting the apparatus-side electricity junction structure 184 with a second electrical connection structure 84 described later causes the circuit board 582 of the liquid container 50 to be electrically connected with the controller 18 of the printer 10. Attachment of the liquid supply unit 90 to the housing 19 results in connecting the liquid connection structure 82 with the apparatus-side liquid junction structure 182 and connecting the second electrical connection structure 84 with the apparatus-side electricity junction structure 184.

The apparatus-side positioning structure 162 is a concave provided in the bottom face 108. The apparatus-side positioning structure 162 is a member configured to determine the position where the liquid supply unit 90 is attached to the housing 19.

Three liquid containers 50 are placed in the container case 94. The liquid containers 50 are placed such that the first sheet 521 is located on the lower side and the second sheet 522 is located on the upper side. In other words, the liquid containers 50 are placed in the container case 94 such that the direction in which the first sheet 521 and the second sheet 522 are opposed to each other is the vertical direction.

Each of the three liquid containers 50 contains black ink. The number of the liquid containers 50 placed in the container case 94 and the color of ink contained in each liquid container 50 are, however, not limited to those of this embodiment described above. For example, two or less liquid containers 50 may be placed in the container case 94, or four or more liquid containers 50 may be placed in the container case 94. A color ink other than black, for example, yellow, magenta or cyan may be contained in the liquid container 50.

The container case 94 (shown in FIG. 8) has the connection units 71 placed inside thereof. The connection units 71 are located on a bottom face 948 of the container case 94. The connection unit 71 includes a foundation portion 702, a contact unit 78 and a liquid introduction portion 762. The foundation portion 702 is a member in an approximately rectangular parallelepiped shape. The foundation portion 702 denotes a portion where the handle portion 53 of the liquid container 50 is placed. The contact unit 78 is placed on the foundation portion 702. The contact unit 78 includes a first electrical connection structure 782 and a holder portion 780 configured to hold the first electrical connection structure 782. The first electrical connection structure 782 consists of a plurality of terminals 785 that are arranged to be brought into contact with the contacts cp of the circuit board 582 (shown in FIG. 5). Nine terminals 785 are provided corresponding to the nine contacts cp. Portions of the terminals 785 are protruded from an inclined surface of the holder portion 780. These protruded portions are brought into contact with the contacts cp. The terminals 785 are electrically connected with housing-side electrical wiring 842 via a relay board placed inside of the foundation portion 702.

The liquid introduction portion 762 is connected with the liquid supply portion 57 of the liquid container 50. The liquid introduction portion 762 is formed in a needle-like shape that allows ink to be flowed inside thereof. The liquid introduction portion 762 is configured to flow the ink from the liquid supply portion 57 (shown in FIG. 4) to the printer 10. The liquid introduction portion 762 has a center axis CL that is parallel to the Z-axis direction. The liquid introduction portion 762 includes a base end portion 764 that is placed on the foundation portion 702-side and a leading end portion 766 that is placed at a position away from the foundation portion 702. The direction in which the liquid introduction portion 762 is extended from the base end portion 764 toward the leading end portion 766 is vertically upward direction (+Z-axis direction). The direction in which the liquid introduction portion 762 is extended (+Z-axis direction) intersects with the moving direction of the container case 94 (X-axis direction). The liquid introduction portion 762 is connected with a liquid introducing flow path portion 822 inside of the foundation portion 702.

The liquid introduction portion 762 and the first electrical connection structure 782 are configured to be visible from outside of the unit housing 91. According to this embodiment, the liquid introduction portion 762 and the first electrical connection structure 782 are made visible from outside of the unit housing 91 by pulling out the container case 94 in the +X-axis direction (i.e., toward the front face 102-side). In this state, the liquid container 50 is moved in the vertically downward direction in such a manner that the first sheet 521 of the liquid container 50 (shown in FIG. 2) faces the bottom face 948. This causes the liquid container 50 to be placed in the container case 94. When the liquid container 50 is placed in the container case 94, the liquid supply portion 57 is connected with the liquid introduction portion 762, and the contacts cp are electrically connected with the terminals 785. The container case 94 is then moved in the −X-axis direction, so as to be pressed into the depth (toward the −X-axis direction side) as shown in FIG. 1. As understood from the foregoing, the moving direction of the liquid container 50 (−Z-axis direction) for connecting the liquid supply portion 57 with the liquid introduction portion 762 intersects with the moving direction of the container case 94 (X-axis direction).

The liquid supply unit 90 (shown in FIG. 7) further includes the liquid connection structure 82, the second electrical connection structure 84, the liquid introducing flow path portion 822 and the housing-side electrical wiring 842. The liquid introducing flow path portion 822 and the housing-side electrical wiring 842 are placed inside of the unit housing 91.

The liquid connection structure 82 is a portion that is to be connected with the apparatus-side liquid junction structure 182. The liquid connection structure 82 has higher rigidity than the liquid introducing flow path portion 822. The liquid connection structure 82 is placed at a position fixed relative to the unit housing 91 (more specifically, its second stationary housing 96B). The ink contained in the liquid container body 52 of each liquid container 50 is flowed through the liquid introducing flow path portion 822, the liquid connection structure 82 and the apparatus-side liquid junction structure 182 toward the printer 10. The liquid connection structure 82 is a tubular member. The liquid connection structure 82 is provided on an upper end face of the second stationary housing 96B.

The liquid introducing flow path portion 822 is a hose having flexibility. The liquid introducing flow path portion 822 is also configured to be expandable and contractible. Three liquid introducing flow path portions 822 are provided corresponding to the number of the liquid containers 50. One end portion of each of the liquid introducing flow path portions 822 is connected with the liquid connection structure 82. The other end portion of each of the liquid introducing flow path portions 822 is connected with the liquid introduction portion 76 (shown in FIG. 8).

The housing-side electrical wiring 842 has one end that is electrically connected with the second electrical connection structure 84 and the other end that is electrically connected with the first electrical connection structure 782. The housing-side electrical wiring 842 is placed inside of the unit housing 91.

The second electrical connection structure (connector) 84 is a portion that is to be electrically connected with the apparatus-side electricity junction structure 184. The second electrical connection structure 84 has higher rigidity than the housing-side electrical wiring 842. The second electrical connection structure 84 is placed at a position fixed relative to the unit housing 91 (more specifically its second stationary housing 96B). The second electrical connection structure 84 is connected with one end portion of the housing-side electrical wiring 842. The second electrical connection structure 84 is a member configured to electrically connect the housing-side electrical wiring 842 with the apparatus-side electrical wiring 188 that is electrically connected with the controller 18 of the printer 10. The second electrical connection structure 84 is provided on the upper end face of the second stationary housing 96B. The liquid connection structure 82 and the second electrical connection structure 84 are arranged side by side.

The unit housing 91 further includes a mounting structure 960 configured to be fit in the housing 19 of the printer 10 and thereby mount the unit housing 91 to the housing 19, and a housing-side positioning structure 962. The mounting structure 960 includes a housing-side first mounting portion 967 and a housing-side second mounting portion 968 that are protruded upward from an upper end face of the first stationary housing 96A. The housing-side first mounting portion 967 is fit in an apparatus-side first mounting portion (not shown) that is provided as a recess in the bottom face 108 of the housing 19. The housing-side second mounting portion 968 is fit in an apparatus-side second mounting portion (not shown) that is provided as a recess in the bottom face of the housing 19. Fitting of the housing-side first mounting portion 967 in the apparatus-side first mounting portion and fitting of the housing-side second mounting portion 968 in the apparatus-side second mounting portion are started at a time prior to starting connection of the liquid connection structure 82 with the apparatus-side liquid junction structure 182 and connection of the second electrical connection structure 84 with the apparatus-side electricity junction structure 184 (at a time prior to connection).

The housing-side positioning structure 962 is a member configured to determine the position of the unit housing 91 relative to the housing 19. The housing-side positioning structure 962 is a cylindrical protrusion. The housing-side positioning structure 962 is provided on the upper end face of the second stationary housing 96B. The housing-side positioning structure 962 is located on the same side as the side where the liquid connection structure 82 and the second electrical connection structure 84 are placed (−X-axis direction) with regard to the moving direction of the container case 94 (X-axis direction). The housing-side positioning structure 962 is arranged adjacent to the liquid connection structure 82 and the second electrical connection structure 84. The housing-side positioning structure 962, the liquid connection structure 82 and the second electrical connection structure 84 are placed in the same corner section of the unit housing 91 in the approximately rectangular parallelepiped shape (corner section located on the −X-axis direction side and the +Y-axis direction side in FIG. 7). Insertion of the housing-side positioning structure 962 into the apparatus-side positioning structure 162 is started at the time prior to connection. Insertion of the housing-side positioning structure 962 into the apparatus-side positioning structure 162 suppresses positional misalignment between the unit housing 91 and the housing 19. The housing-side positioning structure 962 also serves to achieve connection of the liquid connection structure 82 with the apparatus-side liquid junction structure 182 and connection of the second electrical connection structure 84 with the apparatus-side electricity junction structure 184 with high accuracy.

The mounting structure 960 further includes a first opening 969 and a second opening 964. The first opening 969 is a concave (recess) formed in the upper end face of the first stationary housing 96A. The second opening 964 is a concave (recess) formed in the upper end face of the second stationary housing 96B. The first and second openings 969 and 964 respectively define and form spaces to link inside of the unit housing 91 with outside in the state that the unit housing 91 is mounted to the housing 19. The user is allowed to insert the user's hands from outside into the unit housing 91 across these spaces. The first and second openings 969 and 964 respectively correspond to the "opening" described in Solution to Problem. Providing the first and second openings 969 and 964 reduces the likelihood that the user's hand is caught between the housing 19 and the unit housing 91 in the process of mounting and demounting the unit housing 91 to and from the housing 19. For example, when the unit housing 91 is to be mounted to the housing 19, the user may hold regions of the bottom face 108 of the housing 19 corresponding to the first and second openings 969 and 964 to mount the housing 19 and the unit housing 91 to each other. In the course of this mounting, the user's hands are placed in the spaces defined and formed by the first and second openings 969 and 964. This reduces the likelihood that the user's hand is caught between the housing 19 and the unit housing 91.

A-4. Advantageous Effects

According to the embodiment described above, the unit housing 91 is mounted below the printer 10 (as shown in FIG. 1). This configuration suppresses size expansion of the liquid consumption system 1000 in the horizontal direction and readily responds to a change in design, for example, increasing the number of the liquid containers 50 to be placed therein. This accordingly allows for an increase in the amount of ink or an increase in the number of different inks supplied to the printer 10 without increasing the installation area. The liquid containers 50 of the heavier weight are placed below the printer 10. This configuration causes the center of gravity of the liquid consumption system 1000 to be located at the lower position compared with the center of gravity in the configuration that the liquid containers 50 are placed above the printer 10. This accordingly stabilizes the attitude of the liquid consumption system 1000.

According to the embodiment described above, pulling out the container case 94 makes the liquid introduction portion 762 and the first electrical connection structure 782 visible from outside of the unit housing 91 (as shown in FIG. 8). This configuration enables the liquid supply portion 57 to be connected with the liquid introduction portion 762, while allowing the the position of the liquid introduction portion 762 to be checked. This configuration also enables the contacts cp to be brought into contact with the first electrical connection structure 782, while allowing the position of the first electrical connection structure 782 to be checked.

According to the embodiment described above, the liquid supply unit 90 includes the first electrical connection structure 782 placed inside of the unit housing 91 (as shown in FIG. 8). The liquid supply unit 90 also includes the contacts cp (shown in FIG. 5) that are brought into contact with the first electrical connection structure 782 and are thereby electrically connected with the first electrical connection structure 782. This configuration enables the first electrical connection structure 782 to be electrically connected with the contacts cp and thereby allows for transmission of information with regard to the liquid container 50 (for example, the remaining amount of the liquid and the color information of the contained liquid) between the storage device 583 of the liquid container 50 and the controller 18. In another example, a container detection circuit that is electrically connected with the contacts cp may be provided in the liquid supply unit 90. The controller 18 may detect the contact of the first electrical connection structure 782 with the contacts cp in response to a signal from the container detection circuit and may thereby determine that placement of the liquid container 50 into the unit housing 91 is completed. As described above, an electronic device such as the storage device 583 or the container detection circuit may be electrically connected with the contacts cp.

According to the embodiment described above, the housing-side electrical wiring 842 and the liquid introducing flow path portion 822 are placed inside of the unit housing 91 (as shown in FIG. 7). This configuration enables the housing-side electrical wiring 842 and the liquid introducing flow path portion 822 to be protected by the unit housing 91 and thereby reduces the possibility that the housing-side electrical wiring 84 and the liquid introducing flow path portion 822 are damaged.

According to the embodiment described above, the liquid connection structure 82 that is connected with one end portion of the liquid introducing flow path portion 822 is connected with the apparatus-side liquid junction structure 182, so that the apparatus-side liquid junction structure 182 and the liquid introducing flow path portion 822 communicate with each other. This configuration forms an ink flow path that causes the ink contained in the liquid container body 52 to be flowed to the liquid ejection head 13. The liquid introducing flow path portion 822 is a member having elasticity. The liquid introducing flow path portion 822 is thus likely to be displaced in the process of mounting the unit housing 91 to the housing 19. There is accordingly a difficulty in connecting the liquid introducing flow path portion 822 directly with the apparatus-side liquid junction structure 182. The liquid connection structure 82 is, however, placed at the fixed position relative to the unit housing 91 and is thus readily connected with the apparatus-side liquid junction structure 182. This configuration accordingly enables the liquid introducing flow path portion 822 and the apparatus-side liquid junction structure 182 to readily communicate with each other.

According to the embodiment described above, the second electrical connection structure 84 that is connected with one end portion of the housing-side electrical wiring 842 is connected with the apparatus-side electricity junction structure 184, so that the housing-side electrical wiring 842 is electrically connected with the apparatus-side electricity junction structure 184. In the process of mounting the unit housing 91 to the housing 19, the housing-side electrical wiring 842 is likely to be displaced. There is accordingly a difficulty in connecting the apparatus-side electrical wiring 842 directly with the apparatus-side electricity junction structure 184. The second electrical connection structure 84 is, however, placed at the fixed position relative to the unit housing 91 and is thus readily connected with the apparatus-side electricity junction structure 184. This configuration accordingly facilitates electrical connection between the housing-side electrical wiring 842 and the apparatus-side electricity junction structure 184.

According to the embodiment described above, the unit housing 91 includes the mounting structure 960 (shown in FIG. 7). This configuration enables the unit housing 91 to be readily mounted to the printer 10 by fitting the unit housing 91 into the housing 19 of the printer 10.

According to the embodiment described above, the direction in which the liquid introduction portion 762 is extended from the base end portion 764 toward the leading end portion 766 is the vertically upward direction (as shown in FIG. 8). This configuration enables the position of the liquid introduction portion 762 to be made visible further readily. Extending the liquid introduction portion 762 in the vertically upward direction enables the liquid supply portion 57 to be more readily connected with the liquid introduction portion 762, compared with the configuration that the liquid introduction portion 762 is extended obliquely relative to the vertical direction.

According to the embodiment described above, the container case 94 is pulled out, so as to be protruded from the printer 10 in the horizontal direction. This configuration enables the liquid container 50 to be readily placed in the container case 94.

According to the embodiment described above, the liquid container 50 is placed in the container case 94 such that the direction in which the first main surface 521 and the second main surface 522 are opposed to each other is the vertical direction (as shown in FIG. 7). This configuration stabilizes the attitude of the liquid container 50 in the container case 94. The dimension of the liquid container body 52 in the thickness direction (Z-axis direction) that is the direction in which the first main surface 521 and the second main surface 522 are opposed to each other is smaller than the dimensions of the liquid container body 52 in the other directions. This configuration reduces a variation in hydraulic head difference between the liquid ejection head 13 and the liquid level in the liquid container body 52 and thereby enables ink to be more stably supplied from the liquid container body 52 to the liquid ejection head 13.

According to the embodiment described above, the direction in which the liquid introduction portion 762 is extended (Z-axis direction shown in FIG. 8) intersects with the moving direction of the container case 94 (X-axis direction). This configuration enables the liquid container 50 to be moved along a direction intersecting with the moving direction (direction in which the liquid introduction portion 762 is extended), so as to connect the liquid supply portion 57 with the liquid introduction portion 762. The moving direction of the container case 94 intersects with the moving direction of the liquid container 50 (−Z-axis direction) for connecting the liquid supply portion 57 with the liquid introduction portion 762. This configuration enables the liquid container 50 to be moved along the direction intersecting with the moving direction, so as to connect the liquid supply portion 57 with the liquid introduction portion 762. Even when there is a limited space in the moving direction (horizontal direction), this configuration enables the space in the height direction of the liquid consumption system 1000 to be effectively used, in order to place the liquid container 50 into the container case 94.

B. Second Embodiment

Figure 9:
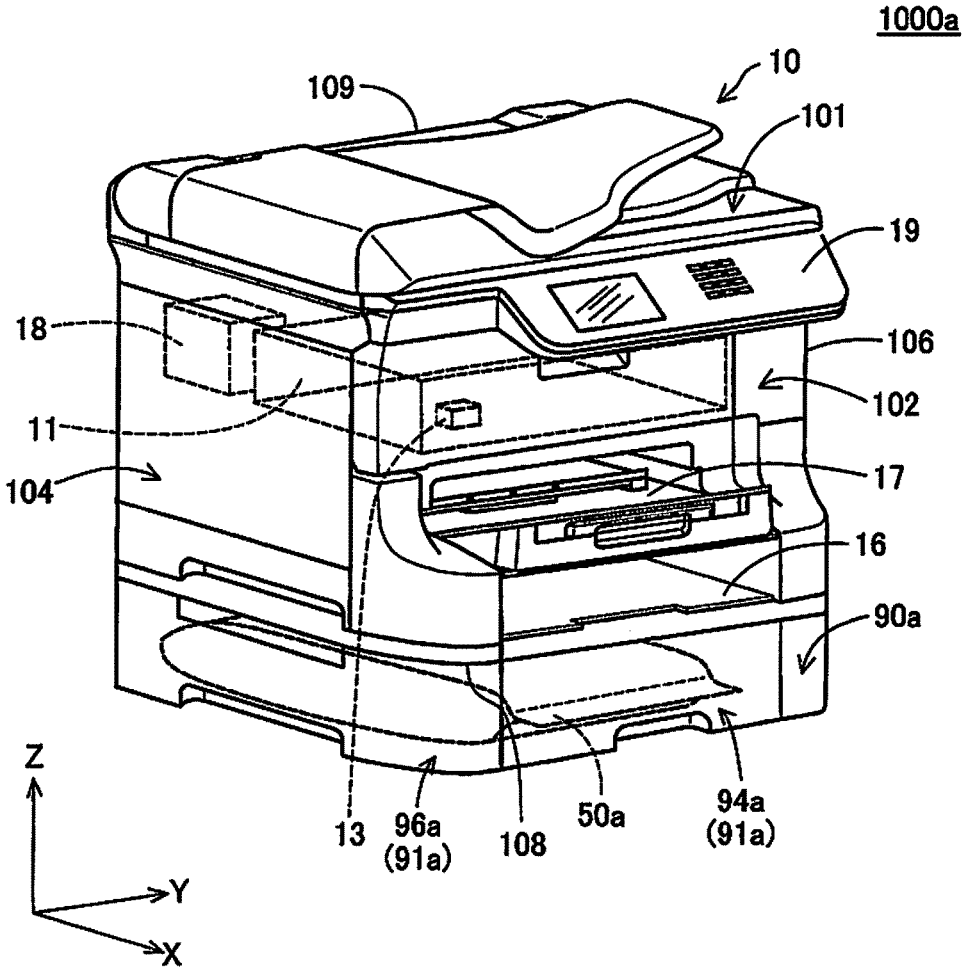
FIG. 9 is a perspective view illustrating a liquid consumption system according to a second embodiment of the disclosure.

FIG. 9 is a perspective view illustrating a liquid consumption system 1000*a* according to a second embodiment of the disclosure. The liquid consumption system 1000*a* of the second embodiment differs from the liquid consumption system 1000 of the first embodiment by the configuration of a liquid supply unit 90*a*. Otherwise the configuration of the second embodiment is similar to the configuration of the first embodiment. The like components to those of the liquid consumption system 1000 of the first embodiment (shown in FIG. 1) are expressed by the like reference signs, and their description is omitted.

A unit housing 91*a* includes a mounting structure 960, a liquid introducing flow path portion 822 and a liquid connection structure 82, like the unit housing 91 of the first embodiment (shown in FIG. 7). The unit housing 91*a* does not include, on the other hand, the housing-side electrical wiring 842, the second electrical connection structure 84 or the contact unit 78. According to another embodiment, the unit housing 91*a* may include the housing-side electrical wiring 842, the second electrical connection structure 84 and the contact unit 78. A container case 94*a* is configured to receive one liquid container 50*a* placed therein. According to another embodiment, the container case 94*a* may be configured to receive two or more liquid containers 50*a* along the Y-axis placed direction.

Figure 10:
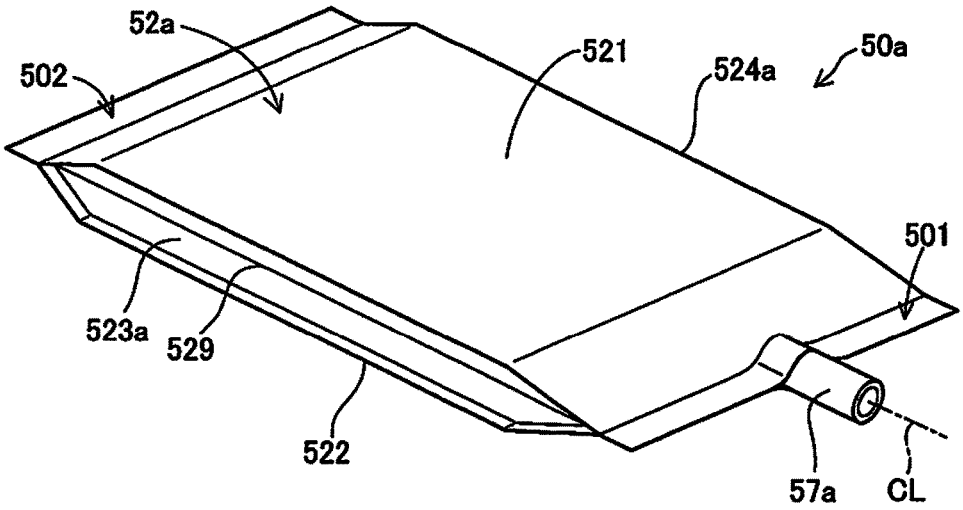
FIG. 10 is a perspective view illustrating a liquid container.

FIG. 10 is a perspective view illustrating a liquid container 50*a*. The liquid container 50*a* differs from the liquid container 50 of the first embodiment (shown in FIG. 2) by the configuration of a container body support assembly including only a liquid supply portion 57*a* and the configuration of a liquid container body 52*a*. Otherwise the configuration of the liquid container 50*a* is similar to the configuration of the liquid container 50 of the first embodiment. The like components are expressed by the like reference signs, and their description is omitted. The liquid supply portion 57*a* is attached to the one end portion 501. The liquid supply portion 57*a* is a tubular member extended along a direction in which the one end portion 501 and the other end portion 502 are opposed to each other. The ink contained in the liquid container body 52*a* is flowed to outside via the liquid supply portion 57*a*.

The liquid container 50*a* is in a gusset-like form in which the liquid container body 52*a* consists of four sheets. The four sheets include a first sheet 521, a second sheet 522, a third sheet 523*a* and a fourth sheet 524*a*. The first sheet 521 forms a front face of the liquid container body 52*a*. The second sheet 522 forms a rear face of the liquid container body 52*a*. The third sheet 523*a* forms a first side face of the liquid container body 52*a*. The fourth sheet 524*a* forms a second side face of the liquid container body 52*a*. The first sheet 521 and the second sheet 522 respectively have larger areas than those of the third sheet 523*a* and the fourth sheet 524*a*. In other words, the first sheet 521 and the second sheet 522 serve as the main surfaces of the liquid container body 52*a*.

The first sheet 521 and the second sheet 522 are opposed to each other. Respective one end portion 501-side ends and the other end portion 502-side ends of the first sheet 521 and the second sheet 522 are bonded to each other by thermal welding or the like. The third sheet 523*a* and the fourth sheet 524*a* are opposed to each other. Respective peripheral areas of the third sheet 523*a* and the fourth sheet 524*a* are bonded to the first sheet 521 and the second sheet 522 by thermal welding or the like. The third sheet 523*a* and the fourth sheet 524*a* respectively have folding lines 529 formed for the purpose of smoothly folding down the liquid container body 52*a* with consumption of ink. The folding lines 529 are extended along a direction perpendicular to the direction in which the volume of the liquid container body 52*a* is reduced.

Figure 11:
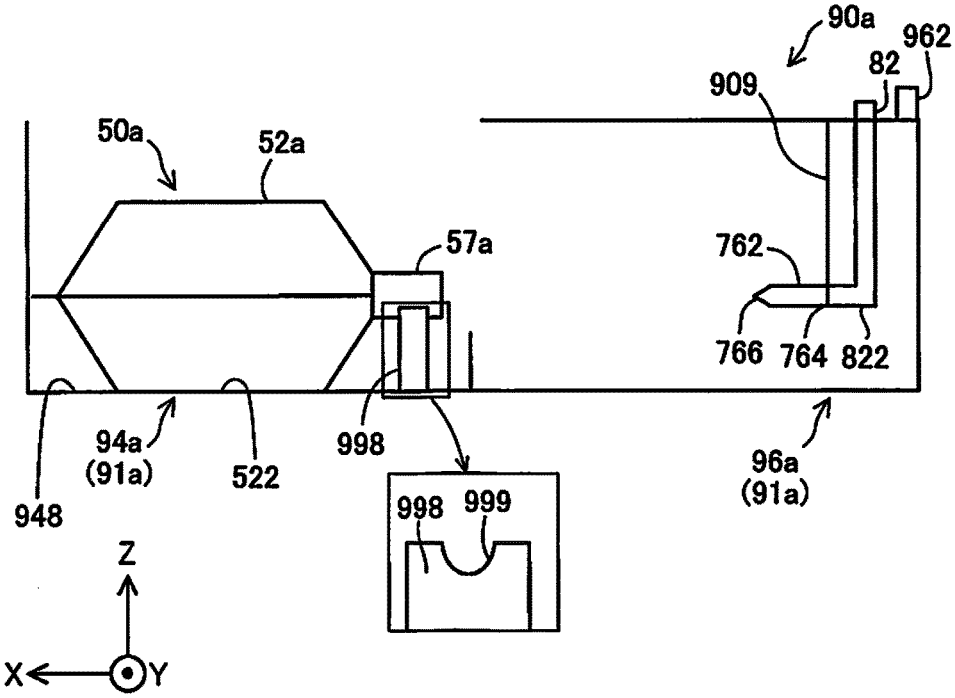
FIG. 11 is a diagram illustrating the internal configuration of a liquid supply unit.

FIG. 11 is a diagram illustrating the internal configuration of the liquid supply unit 90*a*. FIG. 11 illustrates the state that the container case 94*a* is pulled out in the +X-axis direction. Unlike the first embodiment, a liquid introduction portion 762 is provided on a stationary housing 96*a* in the liquid supply unit 90*a* of the second embodiment.

The container case 94*a* has a fixation structure 998 configured to fix the position of the liquid supply portion 57*a*. The fixation structure 998 includes a recess 999 configured to receive the liquid supply portion 57*a* fit therein in the +Z-axis direction and thereby fix the position of the liquid supply portion 57*a*.

The liquid introduction portion 762 is provided on the back side of the stationary housing 96*a* (i.e., on the side of the direction in which the container case 94*a* is pressed into the stationary housing 96*a*). The liquid introduction portion 762 is attached to a partition wall 909 of the stationary housing 96*a*. The direction in which the liquid introduction portion 762 is extended from a base end portion 764 toward a leading end portion 766 (the direction in which the liquid introduction portion 762 is extended) is the horizontal direction (+X-axis direction). The base end portion 764 of the liquid introduction portion 762 is arranged to communicate with a liquid connection structure 82 by means of a liquid introducing flow path portion 822.

In the process of mounting the liquid container 50*a* to the printer 10, the liquid supply portion 57*a* is fixed to the fixation structure 998, and the second sheet 522 of the liquid container body 52*a* is located on a bottom face 948. The container case 94*a* is then moved in the +X-axis direction to be placed in the stationary housing 96*a*. This connects the liquid supply portion 57*a* with the liquid introduction portion 762.

The configuration of the above second embodiment that is similar to the configuration of the above first embodiment provides similar advantageous effects. For example, the unit housing 91*a* is mounted below the printer 10 (as shown in FIG. 9). This configuration suppresses size expansion of the liquid consumption system 1000*a* in the horizontal direction and readily responds to a change in design, for example, increasing the number of the liquid containers 50*a* to be placed therein. This accordingly allows for an increase in the amount of ink or an increase in the number of different inks supplied to the printer 10 without increasing the installation area. The liquid container 50*a* of the heavier weight is placed below the printer 10. This configuration causes the center of gravity of the liquid consumption system 1000*a* to be located at the lower position compared with the center of gravity in the configuration that the liquid container 50*a* is placed above the printer 10. This accordingly stabilizes the attitude of the liquid consumption system 1000*a*.

According to the second embodiment described above, the liquid introduction portion 762 is provided in the stationary housing 96*a* such as not to be exposed to outside of the unit housing 91*a*. This configuration reduces the likelihood that the liquid introduction portion 762 is damaged. The direction in which the liquid introduction portion 762 is extended is the same as the moving direction of the container case 94*a* to be placed into the stationary housing 96*a*. The liquid introduction portion 762 is thus readily connected with the liquid supply portion 57*a* by moving the container case 94*a* with the liquid container 50*a* placed therein. The liquid introduction portion 762 is extended in the horizontal direction. This configuration enables the liquid supply portion 57*a* to be more readily connected with the liquid introduction portion 762, compared with the configuration that the liquid introduction portion 762 is inclined relative to the horizontal direction.

C. Third Embodiment

Figure 12:
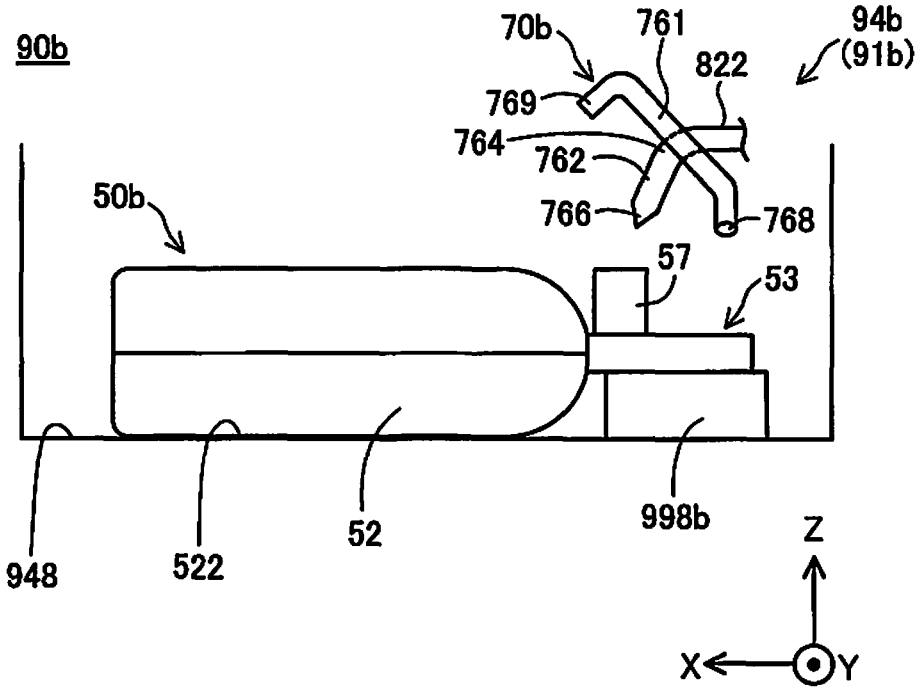
FIG. 12 is a diagram illustrating a liquid supply unit according to a third embodiment of the disclosure.

FIG. 12 is a diagram illustrating a liquid supply unit 90*b* according to a third embodiment of the disclosure. FIG. 12 illustrates a container case 94*b* and a liquid container 50*b* of the liquid supply unit 90*b*. The liquid supply unit 90*b* of the third embodiment differs from the liquid supply unit 90 of the first embodiment (shown in FIG. 7) by mainly the configuration involved in a liquid introduction portion 762 and the configuration of the liquid container 50*b*. Otherwise the configuration of the third embodiment is similar to the configuration of the first embodiment. The like components to those of the liquid supply unit 90 of the first embodiment are expressed by the like reference signs, and their description is omitted. Although not being specifically illustrated, a stationary housing of the liquid supply unit 90*b* includes a mounting structure 960, a housing-side positioning structure 962 and a liquid connection structure 82 like the first embodiment (shown in FIG. 7). The liquid supply unit 90*b* is detachably mounted to the housing 19 at a position below the housing 19 like the first embodiment. The liquid container 50*b* of the third embodiment differs from the liquid container 50 of the first embodiment (shown in FIG. 4) by the absence of the contact placement structure 59 and the circuit board 582.

The container case 94*b* includes an installation base 998*b* on which a handle portion 53 is placed, and a connection structure 70*b*. The installation base 998*b* is located on a bottom face 948. The handle portion 53 is placed on the installation base 998*b*. The connection structure 70*b* includes a lever portion 761 attached to the container case 94*b*, and a rotatable liquid introduction portion 762 attached to the lever portion 761. In the state that the liquid introduction portion 762 is connected with the liquid supply portion 57, the direction in which the liquid introduction portion 762 is extended from a base end portion 764 toward a leading end portion 766 (the direction in which the liquid introduction portion 762 is extended) is the vertical direction (−Z-axis direction). The liquid introduction portion 762 is arranged to communicate with a liquid connection structure (not shown) by means of a liquid introducing flow path portion 822. The lever portion 761 is configured to rotate its other end portion 769 about its one end portion 768 as the fulcrum and thereby rotate the liquid introduction portion 762 in conjunction with this rotation. This rotating operation of the liquid introduction portion 762 connects the liquid introduction portion 762 with the liquid supply portion 57.

In the process of mounting the liquid container 50*b* to the printer 10, the container case 94*b* is pulled out in the +X-axis direction. This causes a space in which the connection structure 70*b* and the liquid container 50*b* are placed to be visible from outside. The user subsequently places the handle portion 53 of the liquid container 50*b* on the installation base 998 in the state that the liquid supply portion 57 faces vertically upward, and places a second sheet 522 of a liquid container body 52 on the bottom face 948. The user then holds the other end portion 769 and rotates the liquid introduction portion 762, so as to insert the liquid introduction portion 762 into the liquid supply portion 57. This connects the liquid supply portion 57 with the liquid introduction portion 762. The user subsequently moves the container case 94*b* in the −X-axis direction to be placed into a stationary housing (not shown). This causes the liquid container 50*b* to be mounted to the printer 10.

The configuration of the above third embodiment that is similar to the configuration of the above first embodiment provides similar advantageous effects. For example, a unit housing 91*b* is mounted below the printer 10. This configuration suppresses size expansion of the liquid consumption system 1000 in the horizontal direction and readily responds to a change in design, for example, increasing the number of the liquid containers 50*b* to be placed therein. This accordingly allows for an increase in the amount of ink or an increase in the number of different inks supplied to the printer 10 without increasing the installation area. The liquid container 50*b* of the heavier weight is placed below the printer 10. This configuration causes the center of gravity of the liquid consumption system to be located at the lower position compared with the center of gravity in the configuration that the liquid container 50*b* is placed above the printer 10. This accordingly stabilizes the attitude of the system.

According to the third embodiment described above, the liquid introduction portion 762 is extended vertically downward (toward the −Z-axis direction). This configuration enables the liquid introduction portion 762 to be readily connected with the liquid supply portion 57, while arranging the liquid supply portion 57 to face vertically upward and allowing the position of the liquid supply portion 57 to be checked. The liquid introduction portion 762 is extended vertically downward. This configuration enables the liquid supply portion 57 to be more readily connected with the liquid introduction portion 762, compared with the configuration that the liquid introduction portion 762 is extended to be inclined relative to the vertical direction.

D. Fourth Embodiment

Figure 13:
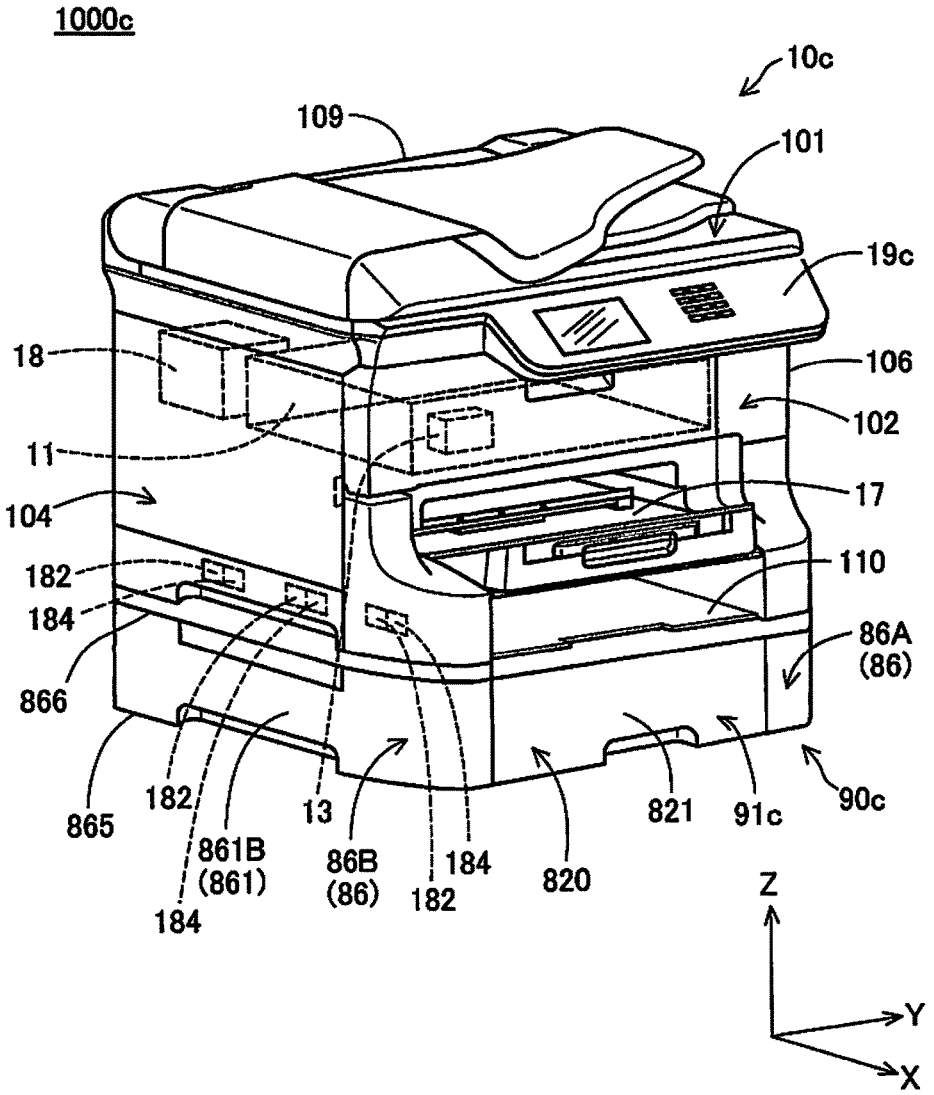
FIG. 13 is a perspective view illustrating a liquid consumption system according to a fourth embodiment of the disclosure.
Figure 14:
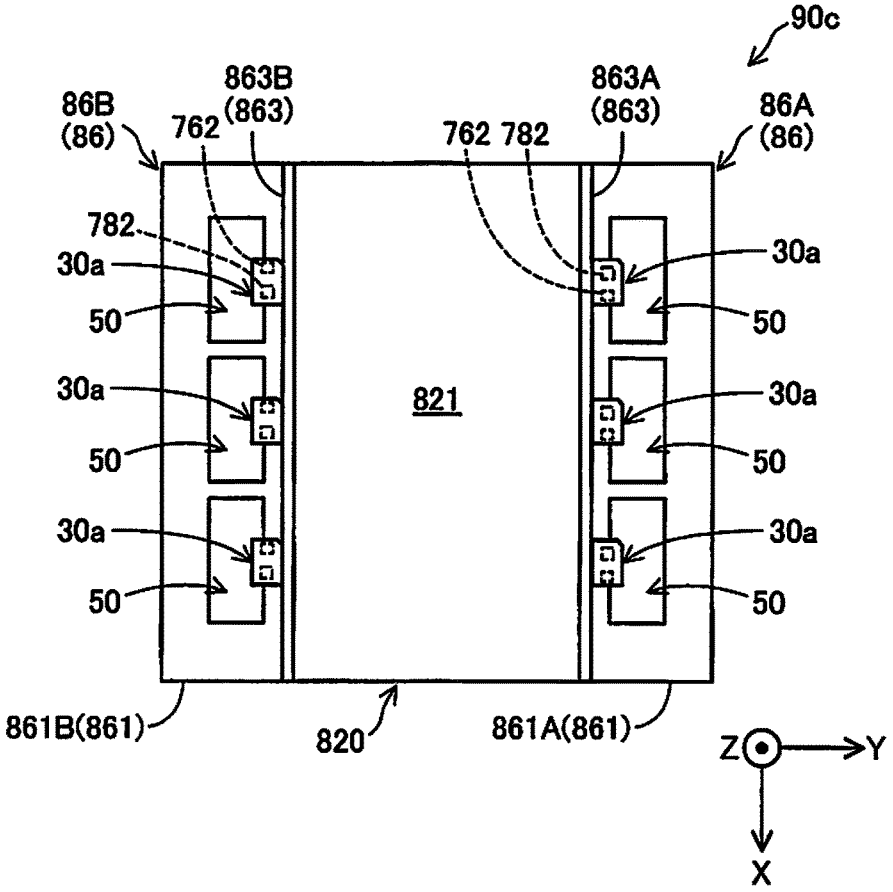
FIG. 14 is a first diagram illustrating the configuration of a liquid supply unit.
Figure 15:
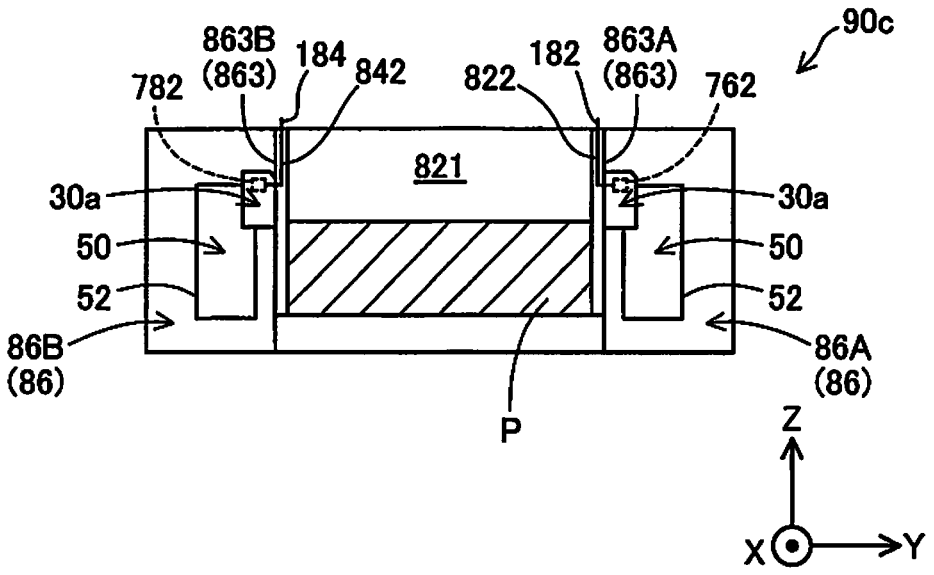
FIG. 15 is a second diagram illustrating the configuration of the liquid supply unit.
Figure 16:
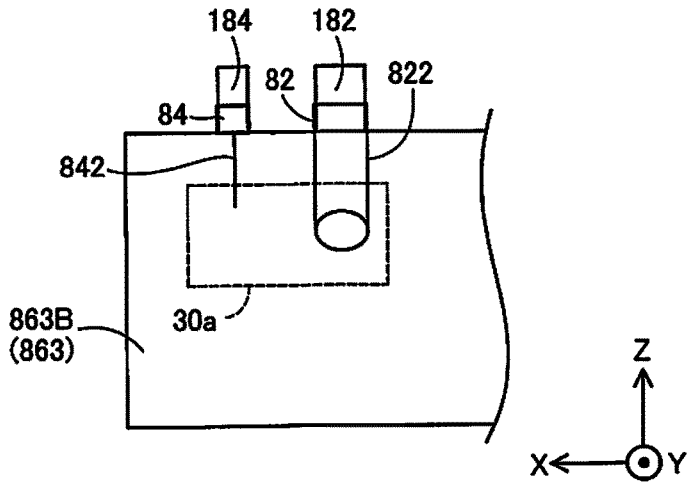
FIG. 16 is a third diagram illustrating the configuration of the liquid supply unit.

FIG. 13 is a perspective view illustrating a liquid consumption system 1000*c* according to a fourth embodiment of the disclosure. FIG. 14 is a first diagram illustrating the configuration of a liquid supply unit 90*c*. FIG. 15 is a second diagram illustrating the configuration of the liquid supply unit 90*c*. FIG. 16 is a third diagram illustrating the configuration of the liquid supply unit 90*c*. The liquid consumption system 1000*c* of the fourth embodiment differs from the liquid consumption system 1000 of the first embodiment (shown in FIG. 1) by mainly the configuration of the liquid supply unit 90*c*. The like components to those of the first embodiment are expressed by the like reference signs, and their description is omitted.

Like the liquid supply unit 90 of the first embodiment, the liquid supply unit 90*c* (shown in FIG. 13) is located below a printer 10*c* and is detachably mounted to a housing 19*c*. The liquid supply unit 90*c* includes a mounting structure 960 and a housing-side positioning structure 962 like the first embodiment (shown in FIG. 7). Apparatus-side liquid junction structures 182 and apparatus-side electricity junction structures 184 are provided on a bottom face of the housing 19*c* for the purpose of connection with a liquid container 50. Six apparatus-side liquid junction structures 182 and six apparatus-side electricity junction structures 184 are provided corresponding to the number (six in this embodiment) of liquid containers 50 placed in the liquid supply unit 90*c*.

The liquid supply unit 90*c* includes a recording medium placement unit 820, a first liquid supply device 86A and a second liquid supply device 86B. The outer shell of the recording medium placement unit 820, the first liquid supply device 86A and the second liquid supply device 86B forms a unit housing 91*c* that serves as the outer shell of the liquid supply unit 90*c*.

The first liquid supply device 86A is located on a −Y-axis direction side of the recording medium placement unit 820. The second liquid supply device 86B is located on a +Y-axis direction side of the recording medium placement unit 820. As described above, the first and the second liquid supply devices 86A and 86B and the recording medium placement unit 820 are arranged side by side in the horizontal direction. The recording medium placement unit 820 is integrated with the first and second liquid supply devices 86A and 86B. When there is no need to distinguish between the first liquid supply device 86A and the second liquid supply device 86B, these are expressed by "liquid supply device 86". The first and second liquid supply devices 86A and 86B have an identical configuration.

The recording medium placement unit 820 is configured to be movable in the X-axis direction (horizontal direction). The user holds a front face 102-side of the recording medium placement unit 820 and pulls the recording medium placement unit 820 in the −X-axis direction, so as to pull out a recording medium holder 821.

The liquid supply device 86 includes a container case 861 configured to receive the liquid container 50 and a mounting/demounting unit 30*a* placed therein. The container case 861 is configured to be openable and closable by rotation of its upper end portion 866 about its lower end portion 856 as the fulcrum. The container case 861 is, however, not limited to the configuration described above but may have any configuration to be openable and closable such as to mount and demount the liquid container 50. For example, the container case 861 may be configured to be openable and closable by rotation of a −X-axis direction side end about a +X-axis direction side end of the container case 861 as the fulcrum.

The mounting/demounting unit 30*a* (shown in FIG. 14) includes a liquid introduction portion 762 and a first electrical connection structure 782. The liquid introduction portion 762 is extended along the horizontal direction. The first electrical connection structure 782 consists of a plurality of terminals 785 (shown in FIG. 8). The first electrical connection structure 782 is held by a holding member that is not illustrated. The mounting/demounting unit 30*a* is configured to support the liquid container 50 such that a container body support assembly 51 of the liquid container 50 (shown in FIG. 2) is located above a liquid container body 52. More specifically, the mounting/demounting unit 30*a* has a support structure configured to support the container body support assembly 51. The liquid introduction portion 762 and the first electrical connection structure 782 are made visible from outside of the unit housing 91*c* by opening the container case 861.

The recording medium placement unit 820 (shown in FIG. 15) includes the recording medium holder (paper feed cassette) 821 configured to hold multiple sheets of printing paper P placed therein. The recording medium holder 821 is formed in a recessed shape that is open on its +Z-axis direction side. The printing paper P placed in the recording medium holder 821 is fed toward the liquid ejection head 13. After the printing paper P is printed by means of the liquid ejection head 13, the printed printing paper P is discharged to a paper eject tray 17.

As shown in FIG. 14, each of the first liquid supply device 86A and the second liquid supply device 86B includes three liquid containers 50 and three mounting/demounting units 30*a*. The three liquid containers 50 are arranged along the X-axis direction that is the horizontal direction. According to this embodiment, inks of black (K), yellow (Y), magenta (M), cyan (C), light magenta (LM) and light cyan (LC) are respectively contained in the individual liquid containers 50.

The mounting/demounting units 30*a* of the first liquid supply device 86A are attached to a surface 863A located on the recording medium placement unit 820-side (+Y-axis direction side), among the surfaces defining and forming a container case 861A. The mounting/demounting units 30*a* of the second liquid supply device 86B are attached to a surface 863B located on the recording medium placement unit 820-side (−Y-axis direction side), among the surfaces defining and forming a container case 861B.

As shown in FIG. 14 and FIG. 15, the recording medium holder 821 and the mounting/demounting units 30*a* including the liquid introduction portions 762 are arranged side by side in the horizontal direction. In other words, with regard to the vertical direction (Z-axis direction), at least the liquid introduction portions 762 are located in a range where the recording medium holder 821 is located.

As shown in FIG. 16, a base end portion of the liquid introduction portion 762 is connected with a liquid introducing flow path portion 822. The liquid introducing flow path portion 822 is arranged to communicate with the apparatus-side liquid junction structure 182 via a liquid connection structure 82. This configuration causes the ink contained in the liquid container body 52 to be flowed through the liquid introduction portion 762, the liquid introducing flow path portion 822, the liquid connection structure 82 and the apparatus-side liquid junction structure 182 toward the printer 10*c*.

An end of housing-side electrical wiring 842 that is electrically connected with a storage device 583 of a circuit board 582 of the liquid container 50 (shown in FIG. 6) is connected with a second electrical connection structure 84. The second electrical connection structure 84 is electrically connected with the apparatus-side electricity junction structure 184.

In the process of mounting the liquid supply unit 90*c* to the housing 19*c*, the liquid connection structure 82 is connected with the apparatus-side liquid junction structure 182, and the second electrical connection structure 84 is connected with the apparatus-side electricity junction structure 184.

The configuration of the above fourth embodiment that is similar to the configuration of the above first embodiment provides similar advantageous effects. For example, the unit housing 91*c* is mounted below the printer 10*c* (as shown in FIG. 13). This configuration suppresses size expansion of the liquid consumption system 1000*c* in the horizontal direction and readily responds to a change in design, for example, increasing the number of the liquid containers 50 to be placed therein. This accordingly allows for an increase in the amount of ink or an increase in the number of different inks supplied to the printer 10*c* without increasing the installation area. The liquid container 50 of the heavier weight is placed below the printer 10. This configuration causes the center of gravity of the liquid consumption system 1000*c* to be located at the lower position compared with the center of gravity in the configuration that the liquid container 50*a* is placed above the printer 10. This accordingly stabilizes the attitude of the liquid consumption system 1000*c*.

E. Modifications

The disclosure is not limited to any of the embodiments and the examples described above but may be implemented by a diversity of other aspects without departing from the scope of the disclosure. Some of possible modifications are given below.

E-1. First Modification

In each of the embodiments described above, the liquid consumption system 1000, 1000*a* or 1000*c* may be configured such that the liquid container 50, 50*a* or 50*b* is attached to a side face (for example, left side face 104) of the housing 19, in addition to the liquid container 50, 50*a* or 50*b* placed in the liquid supply unit 90 to 90*c*.

E-2. Second Modification

The housing-side positioning structure 962 is provided as a protrusion (as shown in FIG. 7) in each of the embodiments described above, but may be any member configured to determine the position of the unit housing 91 relative to the housing 19. For example, the housing-side positioning structure 962 may be provided as a recess. In this modification, the apparatus-side positioning structure 162 may be provided as a protrusion that is to be inserted into the housing-side positioning structure 962 that is the recess.

E-3. Third Modification

The liquid container 50*a* or 50*b* does not include a circuit board in the second and third embodiments described above but may include a circuit board. In this modification, the unit housing 91 may include terminals 785 (shown in FIG. 8) or the like to be electrically connected with the circuit board.

E-4. Fourth Modification

In each of the embodiments described above, each of the liquid supply units 90 and 90*a* to 90*c* may be provided with a pump configured to transfer the ink contained in the liquid container 50, 50*a* or 50*b* to the printer 10, 10*a* or 10*c*. In this modification, the supply mechanism (for example, pump) provided in the printer 10, 10*a* or 10*c* may be omitted. The following describes a concrete example of the fourth modification with regard to the liquid consumption system 1000 of the first embodiment.

Figure 17:
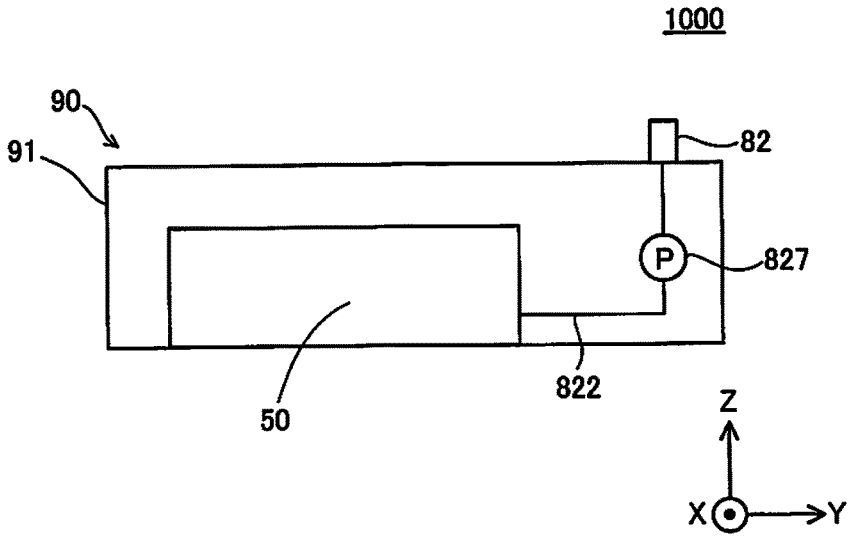
FIG. 17 is a diagram illustrating a configuration that a pump is provided in the liquid supply unit of the first embodiment.

FIG. 17 is a diagram illustrating a configuration that a pump 827 is provided in the liquid supply unit 90 of the first embodiment. The pump 827 is located in the middle of the liquid introducing flow path portion 822. The pump 827 serves to transfer the ink contained in the liquid container 50 (more specifically in the liquid container body 52) to the printer 10. A controller (not shown) of the pump 827 may be electrically connected with the controller 18 of the printer 10 by electrical wiring inside of the unit housing 91 and inside of the housing 19, so as to operate the pump 827 in response to a control signal from the controller 18. Providing the pump 827 in the liquid supply unit 90 as described above enables the ink to be stably supplied from the liquid container 50 located below the printer 10 toward the printer 10.

E-5. Fifth Modification

The disclosure is not limited to the inkjet printer or its liquid container 50 but is also applicable to any liquid consuming apparatus configured to eject any liquid other than ink and a liquid supply unit configured to supply the liquid to the liquid consuming apparatus. For example, the disclosure may be applied to any of various liquid consuming apparatuses and liquid supply units given below:

(1) image recording apparatus such as a facsimile machine;

(2) color material ejection recording apparatus configured to eject a color material used for manufacturing color filters for an image display apparatus such as a liquid crystal display;

(3) electrode material ejection apparatus configured to eject an electrode material used for forming electrodes of, for example, an organic EL (electroluminescence) display and a field emission display (FED);

(4) liquid consuming apparatus configured to eject a bioorganic material-containing liquid used for manufacturing biochips;

(5) sample ejection apparatus used as a precision pipette;

(6) ejection apparatus of lubricating oil;

(7) ejection apparatus of a resin solution;

(8) liquid consuming apparatus for pinpoint consumption of lubricating oil on precision machines such as watches and cameras;

(9) liquid consuming apparatus configured to eject a transparent resin solution, such as an ultraviolet curable resin solution, onto a substrate in order to manufacture a hemispherical microlens (optical lens) used for, for example, optical communication elements;

(10) liquid consuming apparatus configured to eject an acidic or alkaline etching solution in order to etch a substrate or the like; and

(11) liquid consuming apparatus equipped with a liquid consumption head configured to eject a very small volume of droplets of any other liquid.

The "droplet" herein means the state of liquid ejected from the liquid consuming apparatus or the liquid supply unit and may be in a granular shape, a teardrop shape or a tapered threadlike shape. The "liquid" herein may be any material ejectable from the liquid consuming apparatus or the liquid supply unit. The "liquid" may be any material in the liquid phase. For example, liquid-state materials of high viscosity or low viscosity, sols, aqueous gels and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The ink herein includes general water-based inks and oil-based inks, as well as various liquid compositions, such as gel inks and hot-melt inks. In an application that UV ink curable by UV radiation is contained in a liquid container body and is connected with the printer, the liquid container body is away from the placement surface. This reduces the likelihood that the UV ink is cured by transmission of heat from the placement surface to the liquid container body.

The present application claims priority from Japanese patent application 2014-123294 filed on Jun. 16, 2014 and Japanese patent application 2014-163439 filed on Aug. 11, 2014, the contents of which are hereby incorporated by reference into this application.

REFERENCE SIGNS LIST

10, 10*a*, 10*c* printer, 11 recording mechanism, 13 liquid ejection head, 16 paper feed slot, 17 paper eject tray, 18 controller, 19 housing, 30*a* mounting/demounting unit, 50, 50*a*, 50*b* liquid container, 51 container body support assembly, 52, 52*a* liquid container body, 53 handle portion, 54 grip portion, 57, 57*a* liquid supply portion, 59 contact placement structure, 70 flow path-forming member, 70*b* connection structure, 71 connection unit, 76 liquid introduction portion, 78 contact unit, 82 liquid connection structure, 84 second electrical connection structure, 86 liquid supply device, 86A first liquid supply device, 86B second liquid supply device, 90, 90*a*, 90*b*, 90*c* liquid supply unit, 91, 91*a*, 91*b*, 91*c* unit housing, 94, 94*a*, 94*b* container case, 96 stationary housing, 96A first stationary housing, 96B second stationary housing, 99 film, 101 top face, 104 left side face, 106 right side face, 108 bottom face, 109 rear face, 162 apparatus-side positioning structure, 182 apparatus-side liquid junction structure, 184 apparatus-side electricity junction structure, 188 apparatus-side electrical wiring, 372 other end portion, 381, apparatus-side terminal, 501 one end portion, 502 other end portion, 503 first side edge portion, 504 second side edge portion, 521 first sheet (first main surface), 522 second sheet (second main surface), 523, 523*a* third sheet, 521, 524*a* fourth sheet, 529 folding line, 542 receiving space, 546 first connecting portion, 547 second connecting portion, 548 base portion, 549 mounting portion, 572 liquid supply port, 573 supply connecting portion, 580 liquid container-side terminal group, 581A-581I liquid container-side terminal, 582 circuit board, 582*fa* surface, 5821*b* rear face, 583 storage device, 584 boss groove, 585 boss hole, 586 upper end, 587 lower end, 594 bottom, 702 foundation base, 761 lever portion, 762 liquid introduction portion, 764 base end portion, 766 leading end portion, 768 one end portion, 769 other end portion, 780 holder portion, 782 first electrical connection structure, 785 terminal, 820 recording medium placement unit, 821 recording medium holder, 822 liquid introducing flow path portion, 827 pump, 842 housing-side electrical wiring, 856 lower end portion, 861, 861A, 861B container case, 863A surface, 863B surface, 866 upper end portion, 909 partition wall, 948 bottom face, 960 mounting structure, 962 housing-side positioning structure, 964 second opening, 967 housing-side first mounting portion, 968 housing-side second mounting portion, 969 first opening, 998 fixation structure, 998*b* installation base, 999 recess, 1000, 1000*a*, 1000*c* liquid consumption system, P printing paper, CL center axis, CT center axis, cp contact

The invention claimed is:

1. A liquid supply unit comprising:

a liquid container configured to supply a liquid to a liquid consuming apparatus, the liquid container having a liquid supply portion that is arranged to flow out the liquid;

a unit housing located below the liquid consuming apparatus and configured to be detachably mounted to a bottom face of the liquid consuming apparatus, the liquid container being configured to be placed inside of the unit housing; and a liquid introduction portion configured to be connected with the liquid supply portion and to flow the liquid from the liquid supply portion to the liquid consuming apparatus, the liquid introduction portion being placed inside of the unit housing, the unit housing being located below a paper feed slot of the liquid consuming apparatus and being configured to be detachably mounted to an outer surface side of the bottom face of the liquid consuming apparatus.

2. The liquid supply unit according to claim 1, wherein in a state that the unit housing is mounted to the liquid consuming apparatus, the liquid introduction portion is configured to be visible from outside of the unit housing.

3. The liquid supply unit according to claim 1, further comprising:

a liquid introducing flow path portion configured to be connected with the liquid introduction portion and placed inside of the unit housing; and a liquid connection structure configured to be connected with one end portion of the liquid introducing flow path portion and arranged to make the liquid introducing flow path portion communicate with an apparatus-side liquid junction structure of the liquid consuming apparatus that is configured to communicate with a liquid ejection head of the liquid consuming apparatus, wherein the liquid connection structure is placed at a position fixed relative to the unit housing.

4. The liquid supply unit according to claim 1, wherein the liquid introduction portion has a base end portion and a leading end portion, and a direction in which the liquid introduction portion is extended from the base end portion toward the leading end portion is one direction among a vertically upward direction, a vertically downward direction and a horizontal direction.

5. The liquid supply unit according to claim 1, wherein the unit housing includes a container case configured to be movable in a horizontal direction such that the container case is protruded from the liquid consuming apparatus in the horizontal direction, and the liquid container is placed in the container case.

6. The liquid supply unit according to claim 5, wherein the liquid container includes a liquid container body provided to have elasticity and configured to contain the liquid therein, wherein the liquid container body has a first main surface that forms a primary surface and a second main surface that forms another primary surface and is opposed to the first main surface, and the liquid container is placed in the container case such that a direction in which the first main surface and the second main surface are opposed to each other is a vertical direction.

7. The liquid supply unit according to claim 5, wherein the liquid introduction portion is configured to be rotated about a fulcrum, so as to be connected with the liquid supply portion.

8. The liquid supply unit according to claim 5, wherein the liquid introduction portion is placed inside of the container case, and a direction in which the liquid introduction portion is extended intersects with a moving direction of the container case.

9. The liquid supply unit according to claim 5, wherein a moving direction of the container case intersects with a moving direction of the liquid container in order to connect the liquid supply portion with the liquid introduction portion.

10. The liquid supply unit according to claim 1, further comprising a pump configured to transfer the liquid contained in the liquid container to the liquid consuming apparatus.

11. A liquid consumption system, comprising:

a liquid consuming apparatus provided with a recording mechanism configured to perform recording with a liquid ejection head that is arranged to eject a liquid; and the liquid supply unit according to claim 1.

12. The liquid supply unit according to claim 1, further comprising:

a liquid introducing flow path portion configured to be connected with the liquid introduction portion and placed inside of the unit housing;

a liquid connection structure configured to be connected with one end portion of the liquid introducing flow path portion and arranged to make the liquid introducing flow path portion communicate with an apparatus-side liquid junction structure of the liquid consuming apparatus that is configured to communicate with a liquid ejection head of the liquid consuming apparatus; and a positioning structure configured to determine position of the unit housing relative to a housing of the liquid consuming apparatus, wherein the liquid connection structure is arranged at a corner portion of the unit housing, and the positioning structure is arranged at the corner portion.

13. The liquid supply unit according to claim 1, wherein the unit housing constitutes the bottom face of the liquid consuming apparatus when the unit housing is mounted to the liquid consuming apparatus.

14. The liquid supply unit according to claim 1, further comprising a positioning structure configured to determine position of the unit housing relative to a housing of the liquid consuming apparatus, the positioning structure being a protrusion and projecting upward.

15. A liquid supply unit comprising:

a liquid container configured to supply a liquid to a liquid consuming apparatus, the liquid container having a liquid supply portion that is arranged to flow out the liquid;

a unit housing located below the liquid consuming apparatus and configured to be detachably mounted to the liquid consuming apparatus, the liquid container being configured to be placed inside of the unit housing;

a liquid introduction portion configured to be connected with the liquid supply portion and to flow the liquid from the liquid supply portion to the liquid consuming apparatus, the liquid introduction portion being placed inside of the unit housing; and a first electrical connection structure placed inside of the unit housing, the liquid container having a contact configured to be brought into contact with the first electrical connection structure and thereby to be electrically connected with the first electrical connection structure, and the unit housing being located below a paper feed slot of the liquid consuming apparatus and being configured to be detachably mounted to an outer surface side of a bottom face of the liquid consuming apparatus.

16. The liquid supply unit according to claim 15, wherein in a state that the unit housing is mounted to the liquid consuming apparatus, the first electrical connection structure is configured to be visible from outside of the unit housing.

17. The liquid supply unit according to claim 15, further comprising:

housing-side electrical wiring configured to be electrically connected with the first electrical connection structure and placed inside of the unit housing; and a second electrical connection structure configured to be connected with one end portion of the housing-side electrical wiring and arranged to electrically connect the housing-side electrical wiring with an apparatus-side electricity junction structure of the liquid consuming apparatus that is electrically connected with a controller of the liquid consuming apparatus, wherein the second electrical connection structure is placed at a position fixed relative to the unit housing.

18. The liquid supply unit according to claim 15, wherein the unit housing constitutes the bottom face of the liquid consuming apparatus when the unit housing is mounted to the liquid consuming apparatus.

19. The liquid supply unit according to claim 15, further comprising a positioning structure configured to determine position of the unit housing relative to a housing of the liquid consuming apparatus, the positioning structure being a protrusion and projecting upward.

20. A liquid supply unit comprising:

a liquid container configured to supply a liquid to a liquid consuming apparatus, the liquid container having a liquid supply portion that is arranged to flow out the liquid;

a unit housing located below the liquid consuming apparatus and configured to be detachably mounted to an outer surface side of a bottom face of a housing of the liquid consuming apparatus, the liquid container being configured to be placed inside of the unit housing; and a liquid introduction portion configured to be connected with the liquid supply portion and to flow the liquid from the liquid supply portion to the liquid consuming apparatus, the liquid introduction portion being placed inside of the unit housing, the unit housing including a mounting structure configured to be fit in the housing of the liquid consuming apparatus such that the unit housing is mounted to the liquid consuming apparatus, and the mounting structure including a member projecting upward and fitted in a mounting portion provided on the bottom face of the housing of the liquid consuming apparatus.

21. The liquid supply unit according to claim 20, further comprising a positioning structure configured to determine position of the unit housing relative to the housing of the liquid consuming apparatus, the positioning structure being a protrusion.

22. The liquid supply unit according to claim 21, wherein the positioning structure projects upward.

23. The liquid supply unit according to claim 20, wherein the unit housing constitutes the bottom face of the housing of the liquid consuming apparatus when the unit housing is mounted to the liquid consuming apparatus.

24. The liquid supply unit according to claim 20, wherein the mounting structure includes an opening configured in conjunction with the housing to define and form a space that causes a hand to be inserted from outside of the unit housing to inside of the unit housing, in a state that the unit housing is mounted to the housing.

* * * * *